US011631347B2

(12) United States Patent
Song et al.

(10) Patent No.: US 11,631,347 B2
(45) Date of Patent: Apr. 18, 2023

(54) FLEXIBLE DISPLAY DEVICE HAVING A FLEXIBLE DISPLAY PANEL WHICH IS DEFORMED BASED ON DISPLAY DATA STORED BEFORE DEFORMATION OCCURS

(71) Applicant: Samsung Display Co., LTD., Yongin-si (KR)

(72) Inventors: Inbok Song, Hwaseong-si (KR); Sung-Yeol Baek, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 45 days.

(21) Appl. No.: 17/337,323

(22) Filed: Jun. 2, 2021

(65) Prior Publication Data

US 2022/0208029 A1 Jun. 30, 2022

(30) Foreign Application Priority Data

Dec. 28, 2020 (KR) ..... 10-2020-0184848

(51) Int. Cl.
*G09G 3/00* (2006.01)
*G09F 9/30* (2006.01)
*G09G 3/20* (2006.01)

(52) U.S. Cl.
CPC ..... *G09F 9/301* (2013.01); *G09G 3/2092* (2013.01); *G09G 2310/0267* (2013.01); *G09G 2310/0275* (2013.01); *G09G 2380/02* (2013.01)

(58) Field of Classification Search
CPC ..... G09F 9/301; G09G 3/2092; G09G 2310/0275; G09G 2380/02; G09G 2310/0267
See application file for complete search history.

(56) References Cited

U.S. PATENT DOCUMENTS

| | | | | |
|---|---|---|---|---|
| 10,001,809 | B2 | 6/2018 | Seo et al. | |
| 10,175,725 | B2 | 1/2019 | Jung | |
| 10,325,549 | B2 | 6/2019 | Moon | |
| 10,599,185 | B2 | 3/2020 | Yu et al. | |
| 11,009,913 | B2 | 5/2021 | Hirakata et al. | |
| 2008/0115089 | A1* | 5/2008 | Lee | G09G 5/393 715/838 |
| 2018/0137840 | A1* | 5/2018 | Nemoto | G09G 3/00 |
| 2018/0329514 | A1* | 11/2018 | Kwon | G06F 3/03 |
| 2019/0197960 | A1* | 6/2019 | Kim | G09G 3/035 |
| 2020/0226971 | A1* | 7/2020 | Yi | G09G 5/14 |

FOREIGN PATENT DOCUMENTS

| | | |
|---|---|---|
| KR | 20140025231 | 3/2014 |
| KR | 20150063802 | 6/2015 |
| KR | 20160037942 | 4/2016 |
| KR | 20180014386 | 2/2018 |

* cited by examiner

*Primary Examiner* — Sanghyuk Park

(74) *Attorney, Agent, or Firm* — H.C. Park & Associates, PLC

(57) ABSTRACT

A flexible display device including a flexible display panel, and a panel driver configured to receive display data from a host processor, to store the display data, and to drive the flexible display panel based on the display data. While the flexible display panel is deformed, the panel driver drives the flexible display panel based on the display data stored before the flexible display panel is deformed to display an image having a size suitable for a current exposed region of the flexible display panel.

18 Claims, 15 Drawing Sheets

FLEXIBLE DISPLAY DEVICE HAVING A FLEXIBLE DISPLAY PANEL WHICH IS DEFORMED BASED ON DISPLAY DATA STORED BEFORE DEFORMATION OCCURS

CROSS-REFERENCE TO RELATED APPLICATION

This application claims priority from and the benefit of Korean Patent Application No. 10-2020-0184848, filed on Dec. 28, 2020, which is hereby incorporated by reference for all purposes as if fully set forth herein.

BACKGROUND

Field

Embodiments of the invention relate generally to a display device, and more particularly, to a flexible display device, and method of operating the flexible display device.

Discussion of the Background

Flexible display devices, such as a foldable display device or a rollable display device having a display panel, at least a portion of which is deformable, has been recently developed. A flexible display device can be deformed such that a partial region of a flexible display panel is viewed by a user, but the remaining region of the flexible display panel is not viewed by a user. In this case, to reduce power consumption, the flexible display device may drive only the partial region, or an exposed region of the flexible display panel that can be viewed by the user.

However, even if the flexible display panel displays a still image or the same image while the flexible display panel is deformed such that the exposed region viewed by the user is changed, the flexible display device should receive display data corresponding to a current exposed region of the flexible display panel from a host processor in each frame.

The above information disclosed in this Background section is only for understanding of the background of the inventive concepts, and, therefore, it may contain information that does not constitute prior art.

SUMMARY

An embodiment of the invention provides a flexible display device capable of reducing power consumption while a flexible display panel is deformed.

Another embodiment of the invention also provides a method of operating a flexible display device capable of reducing power consumption while a flexible display panel is deformed.

Additional features of the inventive concepts will be set forth in the description which follows, and in part will be apparent from the description, or may be learned by practice of the inventive concepts.

An embodiment of the invention provides a flexible display device including a flexible display panel, and a panel driver configured to receive display data from a host processor, to store the display data, and to drive the flexible display panel based on the display data. While the flexible display panel is deformed, the panel driver drives the flexible display panel based on the display data stored before the flexible display panel is deformed to display an image having a size suitable for a current exposed region of the flexible display panel.

While the flexible display panel is deformed, the panel driver may not receive the display data from the host processor.

While the flexible display panel is deformed, components of the panel driver for receiving the display data may be disabled.

While the flexible display panel is deformed, the panel driver may receive deformation information representing the current exposed region, generate corrected display data representing the image having the size suitable for the current exposed region by correcting the display data stored before the flexible display panel is deformed based on the deformation information, and may drive the flexible display panel based on the corrected display data.

While the flexible display panel is deformed, the current exposed region of the flexible display panel may be gradually changed. While the flexible display panel is deformed, the panel driver may perform a scaling operation on the display data stored before the flexible display panel is deformed such that an image represented by the corrected display data has an aspect ratio substantially a same as an aspect ratio of an image represented by the display data stored before the flexible display panel is deformed and has the size suitable for the current exposed region.

While the flexible display panel is deformed, the current exposed region of the flexible display panel may be gradually changed. When a deformation of the flexible display panel is started, the panel driver may generate scaled display data representing an image corresponding to an exposed region of the flexible display panel after the deformation of the flexible display panel is completed by performing a scaling operation on the display data stored before the flexible display panel is deformed. While the flexible display panel is deformed, the panel driver may output at least a portion of the scaled display data as the corrected display data such that an image represented by the corrected display data has the size or a position suitable for the current exposed region.

The flexible display panel may be a rollable display panel.

In a first deformation state in which the rollable display panel has a minimum exposed region, the panel driver may store the display data representing an image corresponding to the minimum exposed region. While the rollable display panel is deformed from the first deformation state to a second deformation state in which the rollable display panel has a maximum exposed region, the panel driver may generate corrected display data representing an image having an aspect ratio substantially a same as an aspect ratio of the image corresponding to the minimum exposed region and having the size suitable for the current exposed region by performing a scale-up operation on the display data representing the image corresponding to the minimum exposed region, and may drive the rollable display panel based on the corrected display data.

In a second deformation state in which the rollable display panel has a maximum exposed region, the panel driver may store the display data representing an image corresponding to the maximum exposed region. While the rollable display panel is deformed from the second deformation state to a first deformation state in which the rollable display panel has a minimum exposed region, the panel driver may generate corrected display data representing an image having an aspect ratio substantially a same as an aspect ratio of the image corresponding to the maximum exposed region and having the size suitable for the current exposed region by performing a scale-down operation on the display data representing the image corresponding to the maximum exposed region, and may drive the rollable display panel based on the corrected display data.

In a first deformation state in which the rollable display panel has a minimum exposed region, the panel driver may store the display data representing an image corresponding to the minimum exposed region. When the rollable display panel is started to be deformed from the first deformation state to a second deformation state in which the rollable display panel has a maximum exposed region, the panel driver may generate scaled display data representing an image corresponding to the maximum exposed region by performing a scale-up operation on the display data representing the image corresponding to the minimum exposed region. While the rollable display panel is deformed from the first deformation state to the second deformation state, the panel driver may output a portion of the scaled display data corresponding to the current exposed region as corrected display data, and may drive the rollable display panel based on the corrected display data.

In a second deformation state in which the rollable display panel has a maximum exposed region, the panel driver may store the display data representing an image corresponding to the maximum exposed region. When the rollable display panel is started to be deformed from the second deformation state to a first deformation state in which the rollable display panel has a minimum exposed region, the panel driver may generate scaled display data representing an image corresponding to the minimum exposed region by performing a scale-down operation on the display data representing the image corresponding to the maximum exposed region. While the rollable display panel is deformed from the second deformation state to the first deformation state, the panel driver may output corrected display data including the scaled display data to represent the image corresponding to the minimum exposed region at a center position of the current exposed region, and may drive the rollable display panel based on the corrected display data.

In a first deformation state in which the rollable display panel has a minimum exposed region, the panel driver may store the display data representing an image corresponding to the minimum exposed region. While the rollable display panel is deformed from the first deformation state to a second deformation state in which the rollable display panel has a maximum exposed region, the panel driver may generate corrected display data representing an image displayed in an entire region of the current exposed region by performing a scale-up operation on the display data representing the image corresponding to the minimum exposed region, and may drive the rollable display panel based on the corrected display data.

In a second deformation state in which the rollable display panel has a maximum exposed region, the panel driver may store the display data representing an image corresponding to the maximum exposed region. While the rollable display panel is deformed from the second deformation state to a first deformation state in which the rollable display panel has a minimum exposed region, the panel driver may generate corrected display data representing an image displayed in an entire region of the current exposed region by performing a scale-down operation on the display data representing the image corresponding to the maximum exposed region, and may drive the rollable display panel based on the corrected display data.

The flexible display device may further include a sensor formed on the flexible display panel, and configured to sense a deformation of the flexible display panel. While the flexible display panel is deformed, the panel driver may receive deformation information representing the current exposed region from the sensor.

The panel driver may include a frame buffer, a controller configured to receive the display data and an instruction from the host processor, to store the display data in the frame buffer, and reads the display data from the frame buffer, a data driver configured to provide data signals to the flexible display panel based on the display data received from the controller, and a scan driver configured to provide scan signals to the flexible display panel.

The controller may include an input interface configured to receive the display data and the instruction from the host processor, a memory controller configured to store the display data in the frame buffer, and to read the display data from the frame buffer, an instruction controller configured to control the controller based on the instruction received from the host processor, and a scaler configured to perform a scaling operation on the display data read from the frame buffer when the flexible display panel is deformed.

While the flexible display panel is deformed, at least a portion of the input interface may be disabled.

The input interface may include a physical circuit configured to convert the display data and the instruction that are analog signals into digital signals, a deserialization circuit configured to convert the display data and the instruction that are serial signals into parallel signals, a buffer circuit configured to temporarily store the display data and the instruction, and a latch circuit configured to output the display data and the instruction. The memory controller may include an encoder configured to encode the display data such that the encoded display data are stored in the frame buffer, and a decoder configured to decode the encoded display data read from the frame buffer.

While the flexible display panel is deformed, at least a portion of the physical circuit, at least a portion of the deserialization circuit, at least a portion of the buffer circuit, at least a portion of the latch circuit, and the encoder may be disabled.

Another embodiment of the invention provides a method of operating a flexible display device including a flexible display panel. In the method, display data received from a host processor are stored before the flexible display panel is deformed, corrected display data representing an image having a size suitable for a current exposed region of the flexible display panel are generated by performing a scaling operation on the display data stored before the flexible display panel is deformed while the flexible display panel is deformed, and the flexible display panel is driven based on the corrected display data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION OF THE EMBODIMENTS

Figure 1:
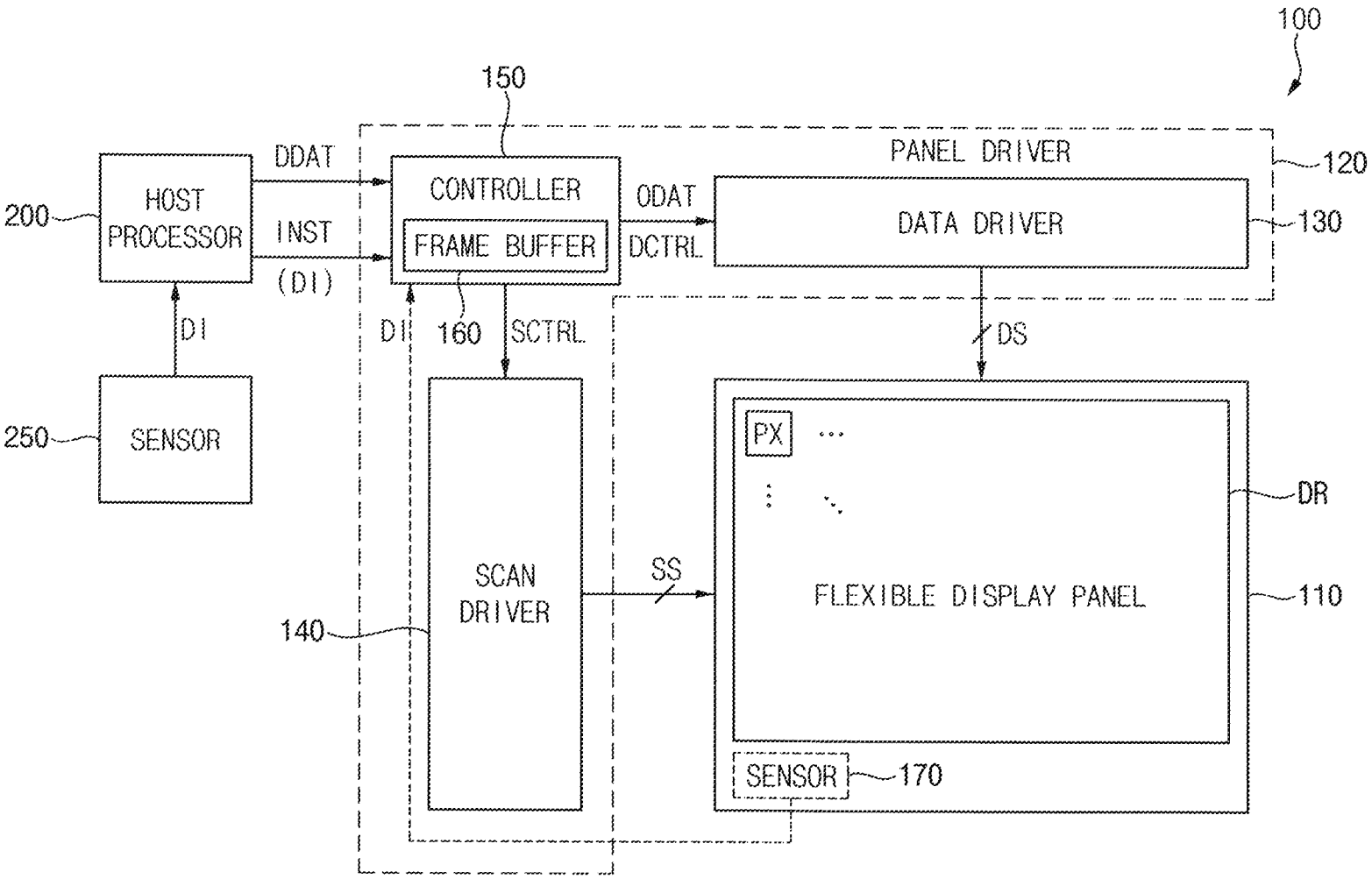
FIG. 1 is a block diagram illustrating a flexible display device according to embodiments.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including,"

when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments of the present inventive concept will be explained in detail with reference to the accompanying drawings.

Figure 2:
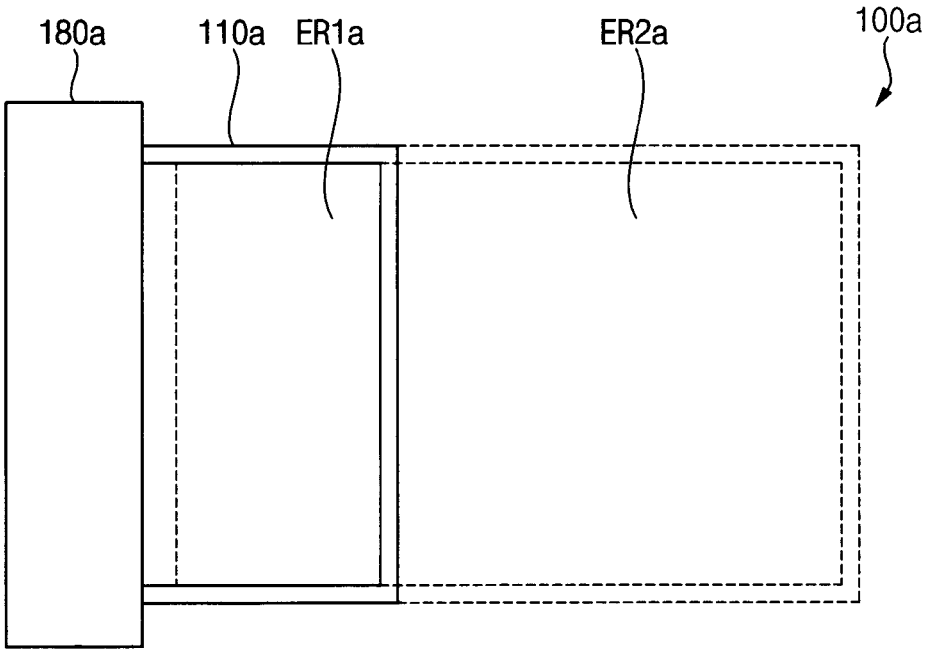
FIG. 2 is a diagram illustrating an example of a flexible display device according to embodiments.
Figure 3:
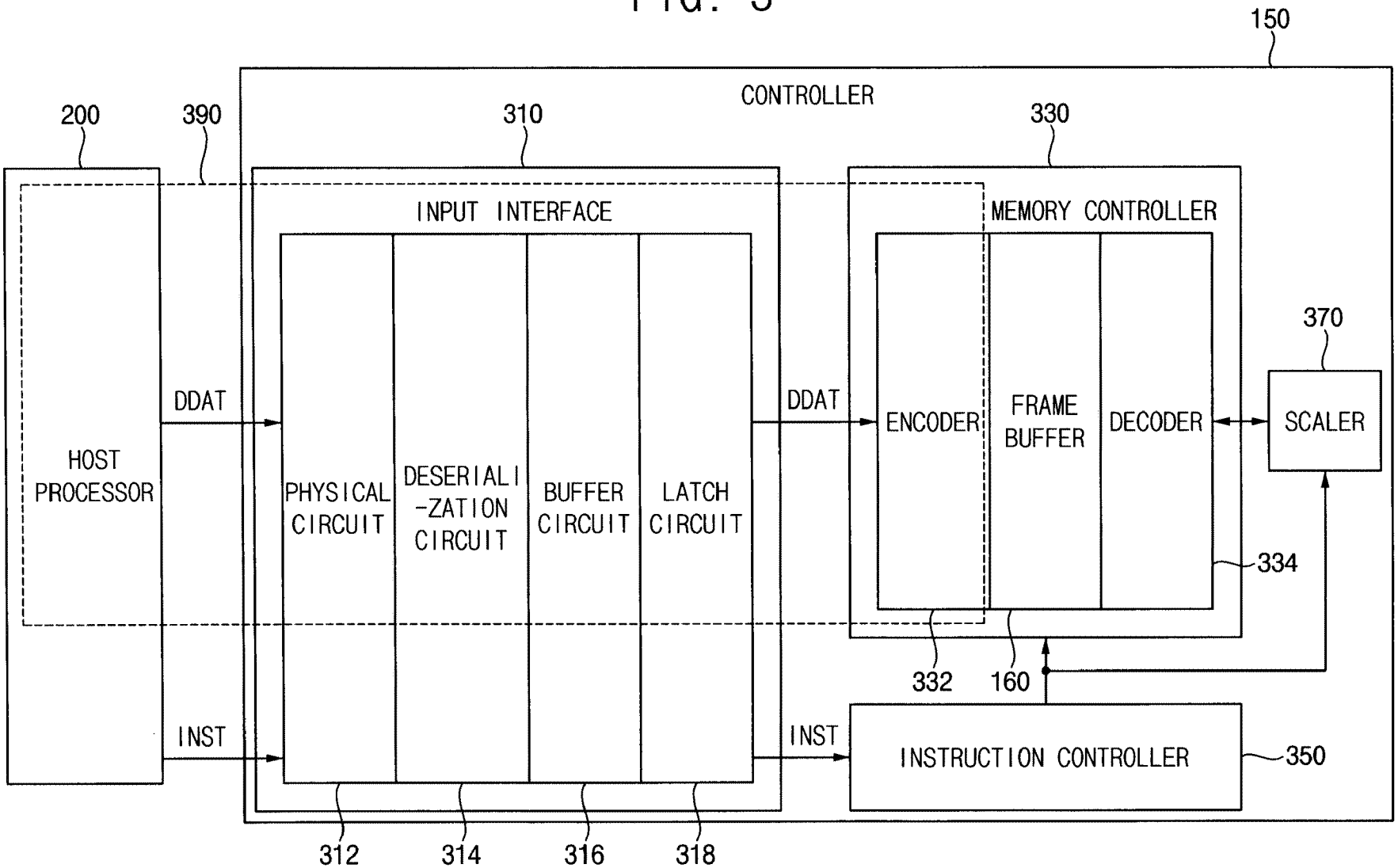
FIG. 3 is a block diagram illustrating an example of a controller included in a flexible display device according to embodiments.

FIG. 1 is a block diagram illustrating a flexible display device according to embodiments; FIG. 2 is a diagram illustrating an example of a flexible display device according to embodiments; and FIG. 3 is a block diagram illustrating an example of a controller included in a flexible display device according to embodiments.

Referring to FIG. 1, a flexible display device 100 according to embodiments may include a flexible display panel 110 that has a display region DR, and a panel driver 120 that drives the flexible display panel 110. In some embodiments, the panel driver 120 may include a data driver 130 that provides data signals DS to the flexible display panel 110, a scan driver 140 that provides scan signals SS to the flexible display panel 110, a controller 150 that controls an operation of the flexible display device 100, and a frame buffer 160.

The flexible display panel 110 may include a plurality of pixels PX in the display region DR. In some embodiments, the flexible display panel 110 may be, but notlimited to, an organic light emitting diode (OLED) display panel where each pixel PX includes an organic light emitting diode. For example, the flexible display panel 110 may be a liquid crystal display (LCD) panel, or any other suitable panel.

In some embodiments, the flexible display panel 110 may be a rollable display panel 110*a*, and the flexible display device 100 may be a rollable display device 100*a* including a receiving part 180*a* that receives the rollable display panel 110*a*. For example, the rollable display panel 110*a* may be unrolled or come out from the receiving part 180*a* such that the rollable display panel 110*a* is deformed from a first deformation state in which the rollable display panel 110*a* has a minimum exposed region ER1*a* to a second deformation state in which the rollable display panel 110*a* has a maximum exposed region ER2*a* or the entire display region DR is exposed. Here, each exposed region ER1*a* and ER2*a* may mean a region that can be viewed by a user in the display region DR of the flexible display panel 110. Further, the rollable display panel 110*a* may be rolled or gone into the receiving part 180*a* such that the rollable display panel 110*a* is deformed from the second deformation state in which the rollable display panel 110*a* has the maximum exposed region ER2*a* to the first deformation state in which the rollable display panel 110*a* has the minimum exposed region ER1*a*. In some embodiments, the rollable display panel 110*a* may be deformed to have an exposed region having any size greater than or equal to the minimum exposed region ER1*a* and less than or equal to the maximum exposed region ER2*a*. Although FIG. 2 illustrates an example where the rollable display device 100*a* includes one receiving part 180*a*, the rollable display device 100*a* may not include the receiving part 180*a*, or may include two or more receiving parts 180*a*.

In other embodiments, the flexible display panel 110 may be any flexible display panel, such as a foldable display panel, a curved display panel, a bendable display panel, a stretchable display panel, or the like.

The data driver 130 may generate the data signals DS based on output image data ODAT and a data control signal DCTRL received from the controller 150, and may provide the data signals DS to the plurality of pixels PX through a plurality of data lines. In some embodiments, the data control signal DCTRL may include, but not be limited to, a data enable signal, a horizontal start signal and a load signal. In some embodiments, the data driver 130 and the controller 150 may be implemented with a single integrated circuit, and the single integrated circuit may be referred to as a timing controller embedded data driver (TED) integrated circuit. In other embodiments, the data driver 130 and the controller 150 may be implemented with separate integrated circuits.

The scan driver 140 may generate the scan signals SS based on a scan control signal SCTRL from the controller 150, and may sequentially provide the scan signals SS to the plurality of pixels PX on a row-by-row basis through a plurality of scan lines. In some embodiments, the scan control signal SCTRL may include, but is not limited to, a scan start signal and a scan clock signal. In some embodiments, the scan driver 140 may be integrated or formed in a peripheral region adjacent to (or within) the display region DR of the flexible display panel 110. In other embodiments, the scan driver 140 may be implemented with one or more integrated circuits.

The controller 150 (e.g., a timing controller (TCON)) may receive display data DDAT and an instruction INST from an external host processor 200 (e.g., an application processor (AP), a graphic processing unit (GPU) or a graphic card). In some embodiments, the display data DDAT may be, but is not limited to, RGB image data including red image data, green image data and blue image data. In some embodiments, the instruction INST may include, but is not limited to, a data transfer start instruction representing a transfer start of the display data DDAT, a luminance change instruction representing a luminance change of an image displayed in the flexible display panel 110, a power reduction mode change instruction representing a change to a power reduction mode, such as an "always on" display (AOD) mode, or the like.

In some embodiments, the instruction INST may further include deformation information DI representing a current exposed region of the flexible display panel 110, or a region that is can be viewed by a user in the display region DR of the flexible display panel 110. For example, the host processor 200 may receive the deformation information DI representing a current deformation degree or the current exposed region of the flexible display panel 110 from a sensor 250 that senses a deformation of the flexible display panel 110, and the controller 150 may receive the deformation information DI generated by the sensor 250 in a form of the instruction INST from the host processor 200. In other embodiments, the flexible display device 100 may further include a sensor 170 formed on the flexible display panel 110, and the controller 150 may receive the deformation information DI representing the current deformation degree or the current exposed region of the flexible display panel 110 from the sensor 170 formed on the flexible display panel 110. For example, the sensor 250 or the sensor 170 for sensing the deformation of the flexible display panel 110 may be implemented with, but is not limited to, a proximity sensor that senses a proximity of an object.

The controller 150 may store the display data DDAT received from the host processor 200 in the frame buffer 160, and may generate the output image data ODAT by reading the display data DDAT from the frame buffer 160. Further, the controller 150 may generate the data control signal DCTRL for controlling an operation of the data driver 130, and may generate the scan control signal SCTRL for controlling an operation of the scan driver 140.

In the flexible display device 100 according to embodiments, while the flexible display panel 110 is deformed, the controller 150 of the panel driver 120 may generate the output image data ODAT representing an image having a size suitable for the current exposed region of the flexible display panel 110 based on the display data DDAT that are stored in the frame buffer 160 before the flexible display panel 110 is deformed, and the data driver 130 of the panel driver 120 may drive the flexible display panel 110 to display the image having the size suitable for the current exposed region based on the output image data ODAT.

While a flexible display panel of a conventional flexible display device is deformed such that an exposed region viewed by a user is changed, even if the flexible display panel displays a still image, or the same image, the conventional flexible display device should receive display data corresponding to a current exposed region of the flexible display panel from a conventional host processor in each frame. However, in the flexible display device 100 according to embodiments, while the flexible display panel 110 is deformed, the flexible display panel 110 may be driven based on the display data DDAT stored before the flexible display panel 110 is deformed, the host processor 200 may not transfer the display data DDAT to the flexible display device 100, and the panel driver 120 may not receive the display data DDAT from the host processor 200. Accordingly, while the flexible display panel 110 is deformed, components of the host processor 200 for transferring the display data DDAT may be disabled, components of the panel driver 120 for receiving the display data DDAT may be disabled, and thus, power consumption of the host processor 200 and power consumption of the flexible display device 100 may be reduced.

For example, while the flexible display panel 110 is deformed, the panel driver 120 may receive the deformation information DI representing the current exposed region of the flexible display panel 110 from the host processor 200 (or from the sensor 170 formed on the flexible display panel 110), may generate corrected display data representing the image having the size suitable for the current exposed region by correcting the display data DDAT stored before the flexible display panel 110 is deformed based on the deformation information DI, and may drive the flexible display panel 110 based on the corrected display data.

Figure 5:
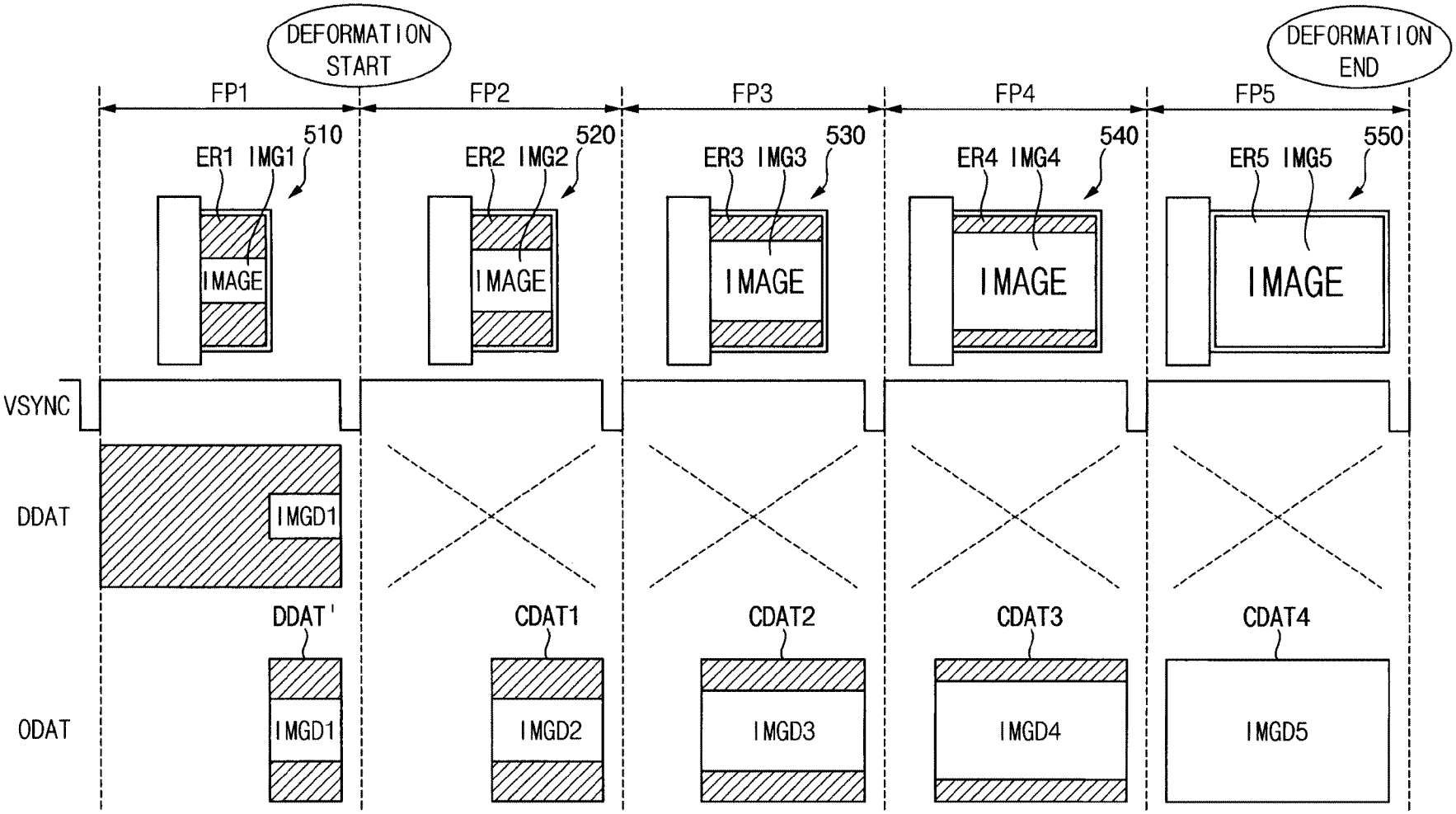
FIG. 5 is a diagram for describing an example of a method of operating a flexible display device according to embodiments.
Figure 7:
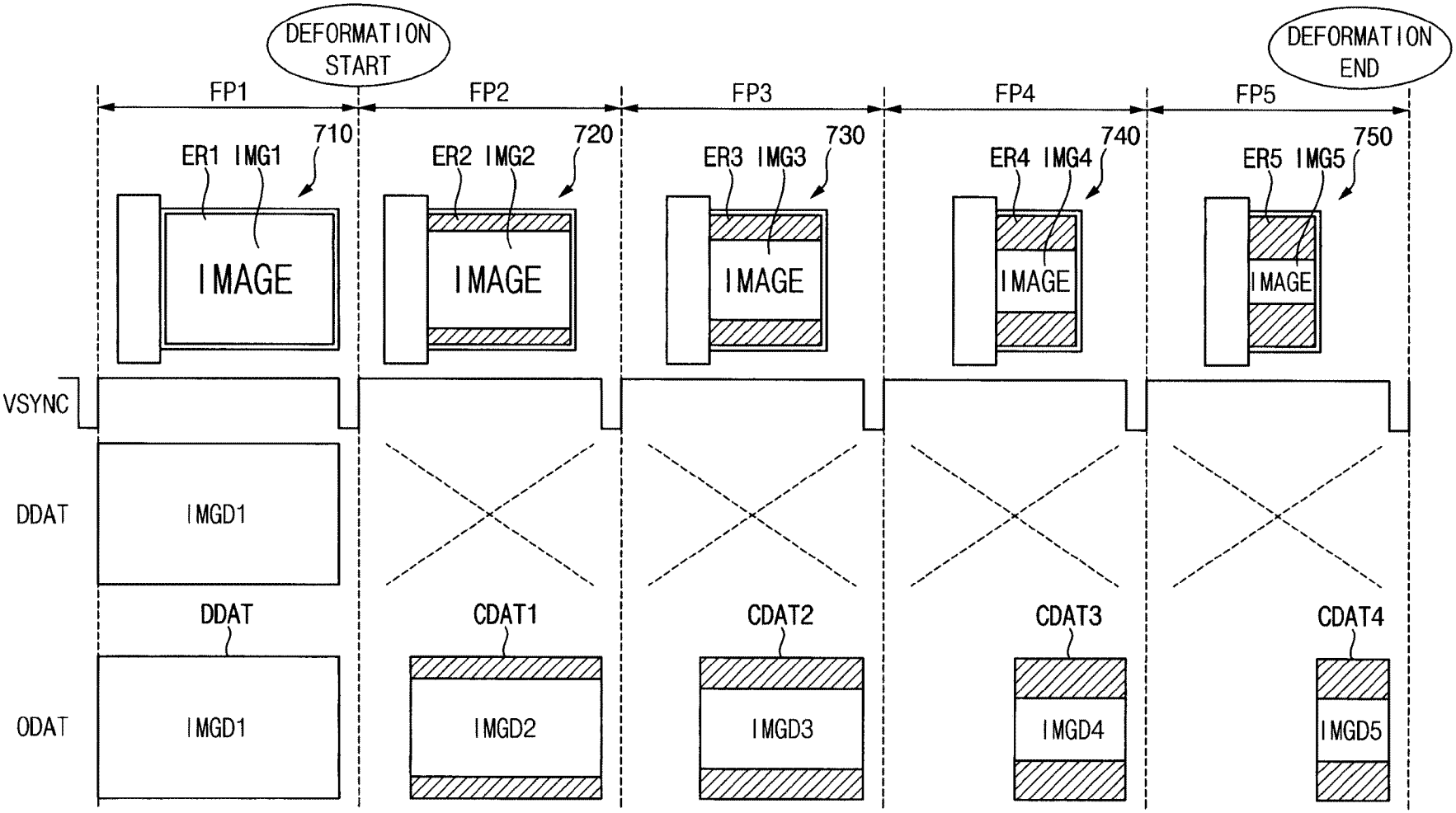
FIG. 7 is a diagram for describing an example of a method of operating a flexible display device according to embodiments.

In some embodiments, for example, as illustrated in FIGS. 5 and 7, while the flexible display panel 110 is deformed, the current exposed region ER1 through ER5 of the flexible display panel 110 may be gradually changed, and the panel driver 120 may perform a scaling operation on the display data IMGD1 stored before the flexible display panel 110 is deformed such that an image IMG2 through IMG5 represented by the corrected display data CDAT1 through CDAT4 has an aspect ratio substantially the same as an aspect ratio of an image IMG1 represented by the display data IMGD1 stored before the flexible display panel 110 is deformed, and has the size suitable for the current exposed region ER1 through ER5. For example, the scaling operation may be a scale-up operation for increasing a size of an image, or may be a scale-down operation for decreasing a size of an image.

Figure 9:
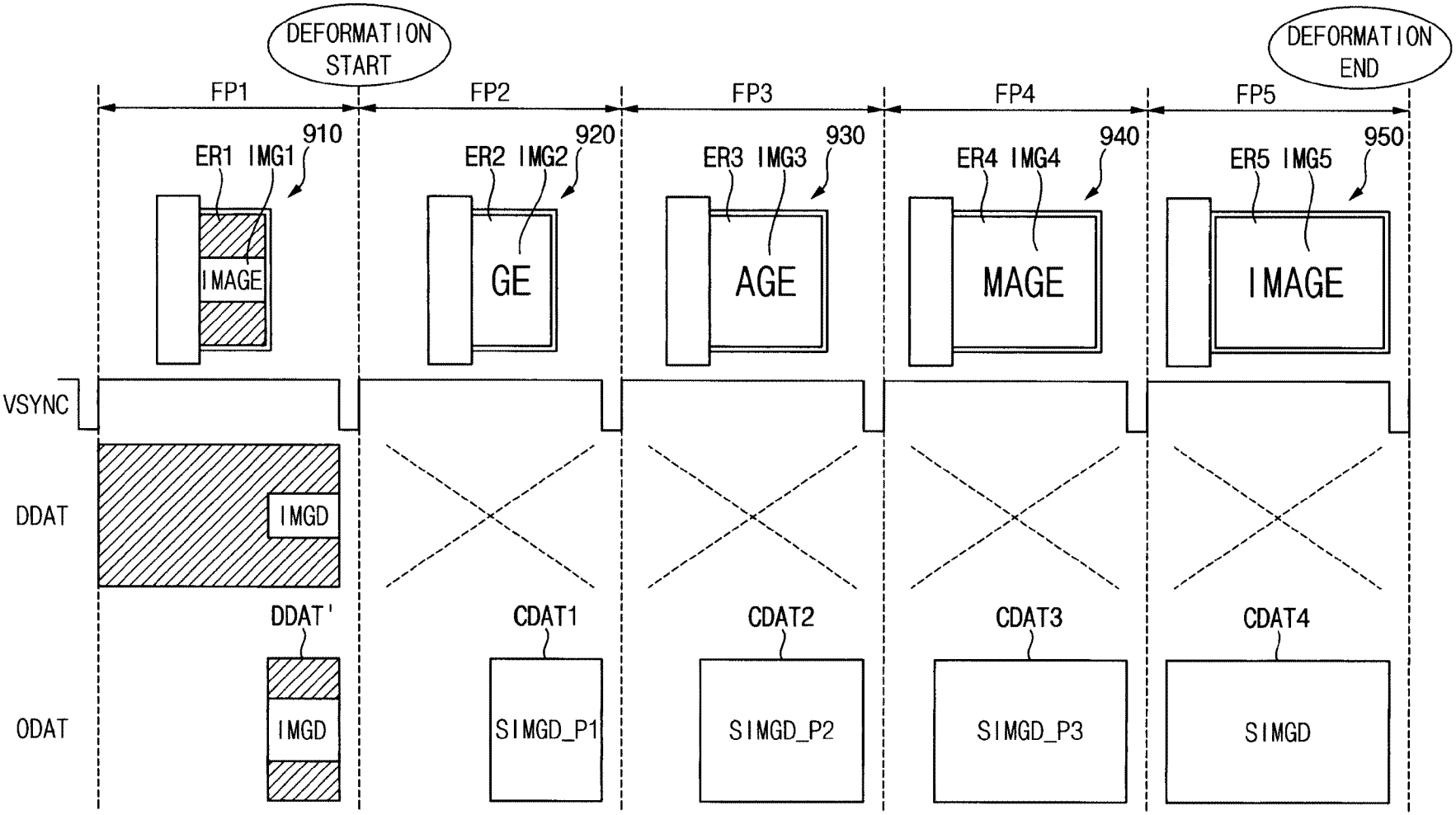
FIG. 9 is a diagram for describing an example of a method of operating a flexible display device according to embodiments.
Figure 11:
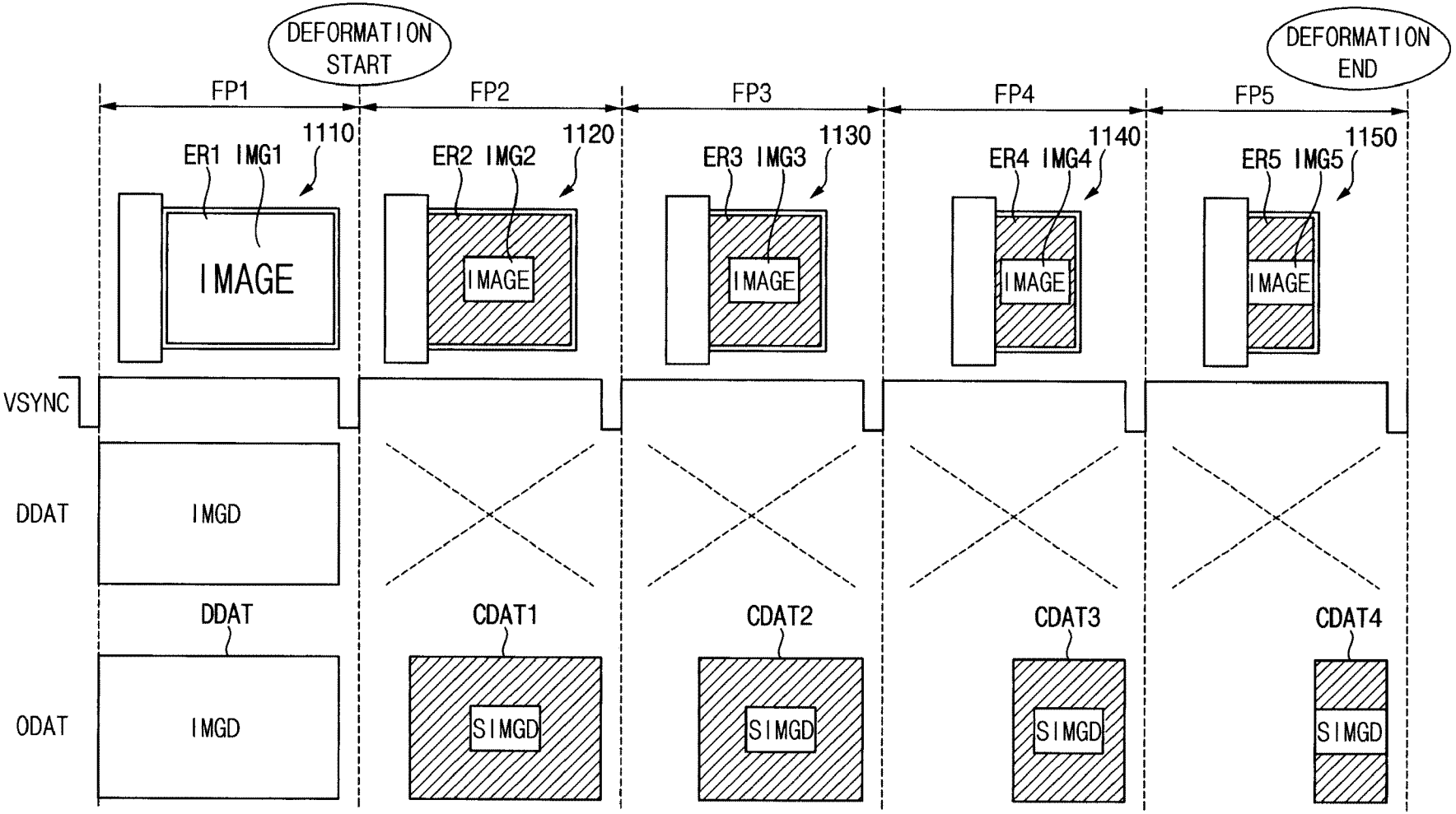
FIG. 11 is a diagram for describing an example of a method of operating a flexible display device according to embodiments.

In other embodiments, for example as illustrated in FIGS. 9 and 11, while the flexible display panel 110 is deformed, the current exposed region ER1 through ER5 of the flexible display panel 110 may be gradually changed. When a deformation of the flexible display panel 110 is started, the panel driver 210 may generate scaled display data SIMGD representing an image IMG5 corresponding to an exposed region ER5 of the flexible display panel 110 after the deformation of the flexible display panel 110 is completed by performing a scaling operation on the display data IMGD stored before the flexible display panel 110 is deformed. While the flexible display panel 110 is deformed, the panel driver 120 may output at least a portion SIMGD_P1, SIMGD_P2, SIMGD_P3 or SIMGD of the scaled display data SIMGD as the corrected display data CDAT1 through CDAT4 such that an image IMG2 through IMG5 represented by the corrected display data CDAT1 through CDAT4 has the size or a position suitable for the current exposed region ER2 through ER5.

To perform these operations, in some embodiments, as illustrated in FIG. 3, the controller 150 of the panel driver 120 may include an input interface 310, a memory controller 330, an instruction controller 350, and a scaler 370.

The input interface 310 may receive the display data DDAT and the instruction INST from the host processor 200. According to embodiments, the display data DDAT and the instruction INST may be transferred between the host processor 200 and the input interface 310 in an interface, such as a mobile industry processor Interface (MIPI), a DisplayPort (DP), an embedded DisplayPort (eDP), or the like. In some embodiments, as illustrated in FIG. 3, the input interface 310 may include, but not be limited to, a physical circuit 312 that converts the display data DDAT and the instruction INST that are analog signals into digital signals, a deserialization circuit 314 that converts the display data DDAT and the instruction INST that are serial signals into parallel signals, a buffer circuit 316 that temporarily stores the display data DDAT and the instruction INST, and a latch circuit 318 that outputs the display data DDAT and the instruction INST.

The memory controller 330 may store the display data DDAT received by the input interface 310 in the frame buffer 160, and may read the display data DDAT from the frame buffer 160. In some embodiments, the frame buffer 160 may be included in the controller 150, as illustrated in FIG. 1, or may be included in the memory controller 330, as illustrated in FIG. 3. However, the location of the frame buffer 160 is not limited to the example of FIG. 1 and/or the example of FIG. 3. In other embodiments, the frame buffer 160 may be located outside the memory controller 330 and/or the controller 150. In some embodiments, the memory controller 330 may include, but is not limited to, an encoder 332 that encodes the display data DDAT such that the encoded display data DDAT are stored in the frame buffer 160, and a decoder 334 that decodes the encoded display data DDAT read from the frame buffer 160. In a case where the memory controller 330 includes the encoder 332 and the decoder 334, since the encoded display data DDAT are stored in the frame buffer 160, a size of the frame buffer 160 may be reduced.

The instruction controller 350 may interpret the instruction INST received from the host processor 200, and may control the controller 150 based on the instruction INST. For example, the instruction controller 350 may receive the data transfer start instruction, the luminance change instruction, the power reduction mode change instruction, or the like as the instruction INST, and may control the controller 150 based on the instructions. In some embodiments, the instruction controller 350 may receive the deformation information DI representing the current exposed region of the flexible display panel 110 as the instruction INST, and may control the memory controller 330 and the scaler 370 based on the deformation information DI.

The scaler 370 may perform a scaling operation on the display data DDAT read from the frame buffer 160 when the flexible display panel 110 is deformed. For example, the scaler 370 may perform a scale-up operation on the display data DDAT to generate corrected display data having a size greater than a size of an image represented by the display data DDAT, or may perform a scale-down operation on the display data DDAT to generate corrected display data having a size less than a size of an image represented by the display data DDAT.

In some embodiments, while the flexible display panel 110 is deformed, the display data DDAT may not be transferred between the host processor 200 and the input interface 310, and at least a portion of the host processor 200, at least a portion of the input interface 310, and the encoder 332 of the memory controller 330 as illustrated by a dotted line 390 in FIG. 3 may be disabled. For example, while the flexible display panel 110 is deformed, at least a portion of the physical circuit 312, at least a portion of the deserialization circuit 314, at least a portion of the buffer circuit 316, at least a portion of the latch circuit 318, and the encoder 332 may be disabled. Accordingly, the power consumption of the host processor 200 and the power consumption of the flexible display device 100 may be reduced.

As described above, in the flexible display device 100 according to embodiments, while the flexible display panel 110 is deformed, the panel driver 120 may drive the flexible display panel 110 based on the display data DDAT stored before the deformation of the flexible display panel 110 to display the image having the size suitable for the current exposed region of the flexible display panel 110. Accordingly, while the flexible display panel 110 is deformed, the display data DDAT may not be transferred between the host processor 200 and the flexible display device 100, and the power consumption may be reduced.

Figure 4:
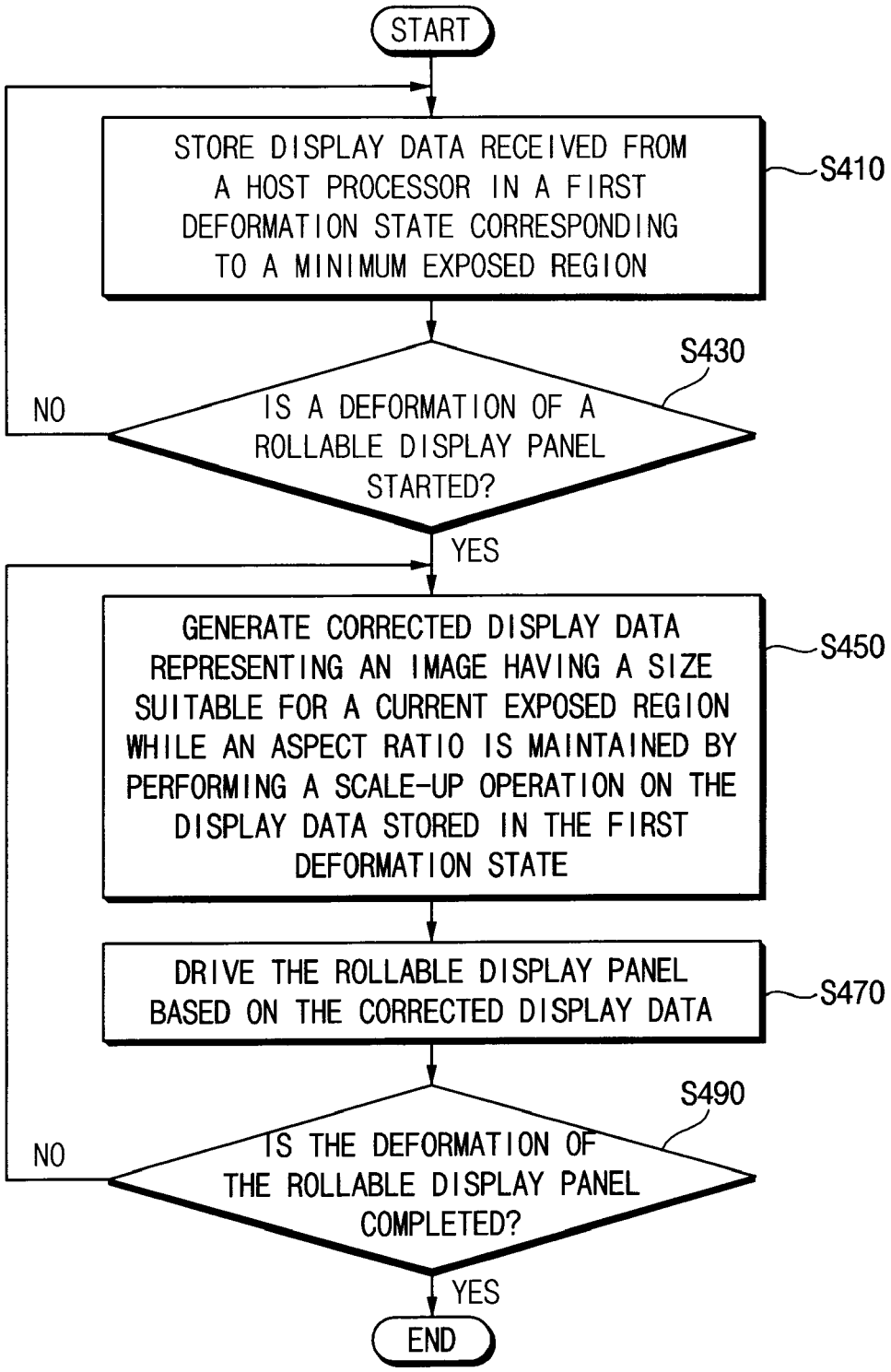
FIG. 4 is a flowchart illustrating a method of operating a flexible display device according to embodiments.

FIG. 4 is a flowchart illustrating a method of operating a flexible display device according to embodiments; and FIG. 5 is a diagram for describing an example of a method of operating a flexible display device according to embodiments.

Referring to FIGS. 1 and 4, in a method of operating a flexible display device 100 including a flexible display panel 110 according to embodiments, the flexible display panel 110 may be a rollable display panel. Before the rollable display panel 110 is deformed, a panel driver 120 may receive display data DDAT from a host processor 200, may store the display data DDAT received from the host processor 200 in a frame buffer 160 (S410), and may drive the rollable display panel 110 based on the display data DDAT. In some embodiments, before the rollable display panel 110 is deformed, as illustrated in FIG. 5, the rollable display panel 110 may be in a first deformation state 510 in which the rollable display panel 110 has a minimum exposed region ER1. For example, in a first frame period FP1 before the rollable display panel 110 is deformed, a controller 150 of the panel driver 120 may receive display data IMGD1 for an image IMG1 corresponding to the minimum exposed region ER1 (and/or black image data for the remaining region of a display region DR, except for the minimum exposed region ER1) as the display data DDAT from the host processor 200, may store the display data IMGD1 for the image IMG1 corresponding to the minimum exposed region ER1 in the frame buffer 160, and may output display data DDAT' for the minimum exposed region ER1 among the display data DDAT received from the host processor 200 as output image data ODAT to a data driver 130. The data driver 130 of the panel driver 120 may drive the rollable display panel 110 to display the IMG1 corresponding to the minimum exposed region ER1 based on the display data DDAT'. In some embodiments, until the rollable display panel 110 is deformed (S430), these operations (S410) may be repeated.

While the rollable display panel 110 is deformed, the panel driver 120 may generate corrected display data CDAT1 through CDAT4 representing an image having a size suitable for a current exposed region of the rollable display panel 110 by performing a scaling operation on the display data IMGD1 stored in the frame buffer 160 before the rollable display panel 110 is deformed, and may drive the rollable display panel 110 based on the corrected display data CDAT1 through CDAT4 (S430, S450, S470, and S490).

In some embodiments, as illustrated in FIG. 5, the rollable display panel 110 may be deformed from the first deformation state 510 in which the rollable display panel 110 has the minimum exposed region ER1 to a second deformation state 550 in which the rollable display panel 110 has a maximum exposed region ER5.

If a deformation of the rollable display panel 110 is started (S430: YES), the panel driver 120 may generate the corrected display data CDAT1 through CDAT4 representing an image IMG2 through IMG5 having an aspect ratio substantially the same as an aspect ratio of the image IMG1 corresponding to the minimum exposed region ER1 and having a size suitable for the current exposed region ER2 through ER5 by performing a scale-up operation on the display data IMGD1 representing the image IMG1 corresponding to the minimum exposed region ER1 stored in the first deformation state 510 (S450), and may drive the rollable display panel 110 based on the corrected display data CDAT1 through CDAT4 (S470). In some embodiments, until the deformation of the rollable display panel 110 is completed (S490), these operations (S450 and S470) may be repeated.

For example, in a second frame period FP2 in which the rollable display panel 110 is deformed to a deformation state 520 corresponding to a second exposed region ER2 greater than the minimum exposed region ER1, the controller 150 may not receive the display data DDAT from the host processor 200, may generate scaled display data IMGD2 representing an image IMG2 having an aspect ratio substantially the same as the aspect ratio of the image IMG1 and a size suitable for the current exposed region ER2 in the deformation state 520 by performing a scale-up operation on the display data IMGD1 representing the image IMG1 corresponding to the minimum exposed region ER1, and may output corrected display data CDAT1 including the scaled display data IMGD2 as the output image data ODAT to the data driver 130. The data driver 130 may drive the rollable display panel 110 to display the image IMG2 having a size suitable for the current exposed region ER2 based on the corrected display data CDAT1.

Similarly, in third, fourth, and fifth frame periods FP3, FP4, and FP5 in which the rollable display panel 110 is deformed to deformation states 530, 540, and 550 such that the current exposed region ER3, ER4 and ER5 is gradually increased, the controller 150 may not receive the display data DDAT from the host processor 200, may generate scaled display data IMGD3, IMGD4 and IMGD5 representing an image IMG3, IMG4 and IMG5 having an aspect ratio substantially the same as the aspect ratio of the image IMG1 and a size suitable for the current exposed region ER3, ER4 and ER5 in each deformation state 530, 540 and 550 by performing a scale-up operation on the display data IMGD1 representing the image IMG1 corresponding to the minimum exposed region ER1, and may output corrected display data CDAT2, CDAT3 and CDAT4 including the scaled display data IMGD3, IMGD4 and IMGD5 as the output image data ODAT to the data driver 130. The data driver 130 may drive the rollable display panel 110 to display the image IMGD3, IMGD4 and IMGD5 having the size suitable for the current exposed region ER3, ER4 and ER5 based on the corrected display data CDAT2, CDAT3 and CDAT4.

Although FIG. 5 illustrates an example where the rollable display panel 110 is deformed from the first deformation state 510 corresponding to the minimum exposed region ER1 to the second deformation state 550 corresponding to the maximum exposed region ER5 during four frame periods FP2, FP3, FP4 and FP5 each defined by a vertical synchronization signal VSYNC, the number of the frame periods FP2, FP3, FP4 and FP5 during which the rollable display panel 110 is deformed from the first deformation state 510 to the second deformation state 550 is not limited to the example of FIG. 5.

As described above, in the method of operating the flexible display device 100 according to the inventive concepts, while the rollable display panel 110 is deformed, the panel driver 120 may drive the rollable display panel 110 to display the image IMG2, and IMG5 having a size suitable for the current exposed region ER2, ER3, ER4, and ER5 of the rollable display panel 110 by performing the scale-up operation on the display data IMGD1 stored before the deformation of the rollable display panel 110. Accordingly, while the rollable display panel 110 is deformed, the display data DDAT may not be transferred between the host processor 200 and the flexible display device 100, and power consumption may be reduced.

Figure 6:
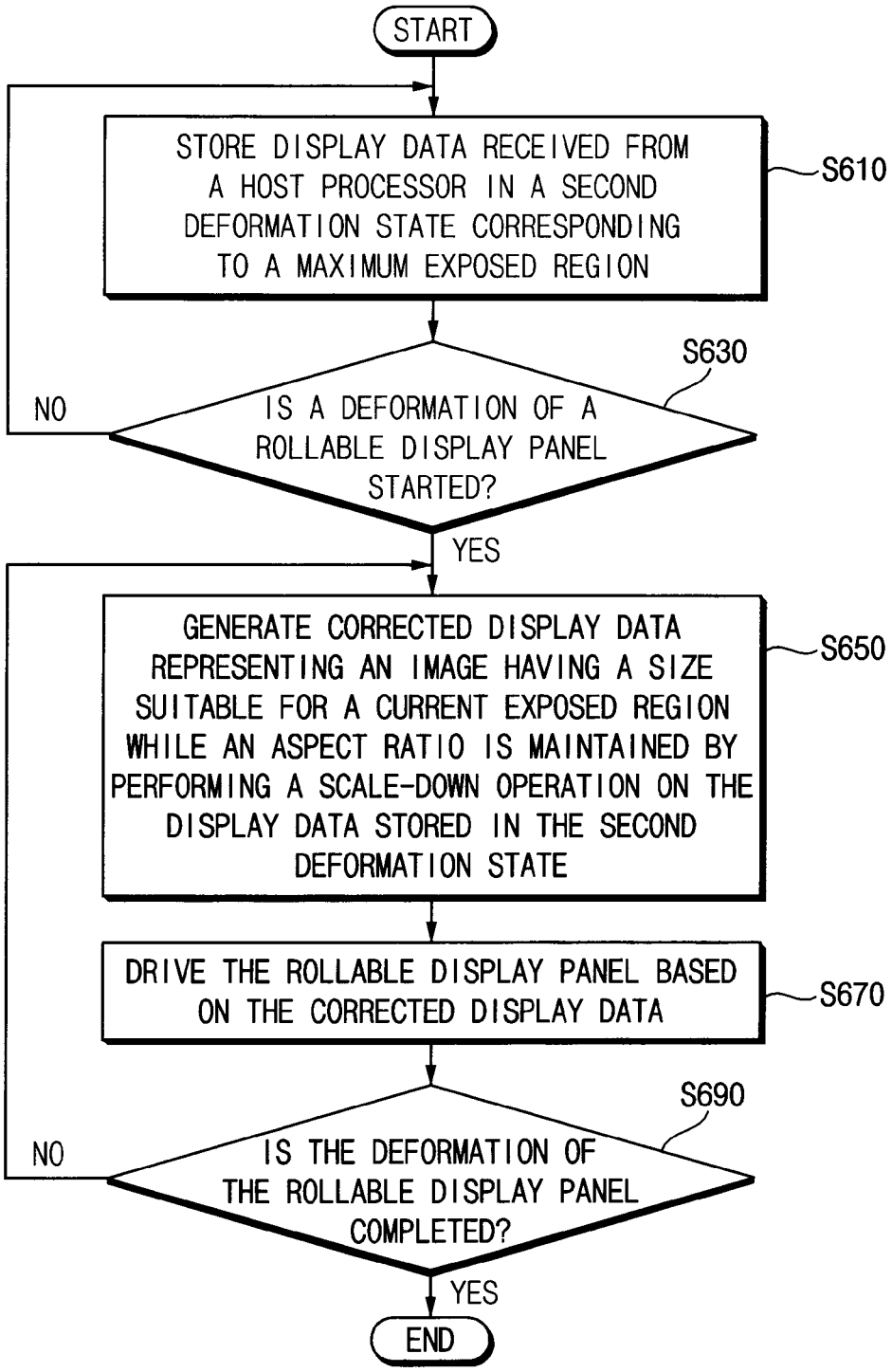
FIG. 6 is a flowchart illustrating a method of operating a flexible display device according to embodiments.

FIG. 6 is a flowchart illustrating a method of operating a flexible display device according to embodiments; and FIG. 7 is a diagram for describing an example of a method of operating a flexible display device according to embodiments.

Referring to FIGS. 1 and 6, in a method of operating a flexible display device 100 including a flexible display panel 110 according to embodiments, the flexible display panel 110 may be a rollable display panel. Before the rollable display panel 110 is deformed, as illustrated in FIG. 7, the rollable display panel 110 may be in a second deformation state 710 corresponding to a maximum exposed region ER1. In a first frame period FP1 before the rollable display panel 110 is deformed, a controller 150 of a panel driver 120 may receive display data IMGD1 for an image IMG1 corresponding to the maximum exposed region ER1 as display data DDAT from a host processor 200, may store the display data IMGD1 for the image IMG1 corresponding to the maximum exposed region ER1 in a frame buffer 160 (S610), and may output the display data IMGD1 for the image IMG1 corresponding to the maximum exposed region ER1 as output image data ODAT to a data driver 130. The data driver 130 of the panel driver 120 may drive the rollable display panel 110 to display the IMG1 corresponding to the maximum exposed region ER1 based on the display data DDAT. In some embodiments, until the rollable display panel 110 deformed (S630), these operations (S610) may be repeated.

While the rollable display panel 110 is deformed, the panel driver 120 may generate corrected display data CDAT1 through CDAT4 representing an image having a size suitable for a current exposed region of the rollable display panel 110 by performing a scaling operation on the display data IMGD1 stored in the frame buffer 160 before the rollable display panel 110 is deformed, and may drive the rollable display panel 110 based on the corrected display data CDAT1 through CDAT4 (S630, 5650, 5670, and S690).

In some embodiments, as illustrated in FIG. 7, the rollable display panel 110 may be deformed from the second deformation state 750 in which the rollable display panel 110 has the maximum exposed region ER1 to a first deformation state 710 in which the rollable display panel 110 has a minimum exposed region ER5.

If a deformation of the rollable display panel 110 is started (S630: YES), the panel driver 120 may generate the corrected display data CDAT1 through CDAT4 representing an image IMG2 through IMG5 having an aspect ratio substantially the same as an aspect ratio of the image IMG1 corresponding to the maximum exposed region ER1 and having a size suitable for the current exposed region ER2 through ER5 by performing a scale-down operation on the display data IMGD1 representing the image IMG1 corresponding to the maximum exposed region ER1 stored in the second deformation state 710 (S650), and may drive the rollable display panel 110 based on the corrected display data CDAT1 through CDAT4 (S670). In some embodiments, until the deformation of the rollable display panel 110 is completed (S690), these operations (S650 and S670) may be repeated.

For example, in a second frame period FP2 in which the rollable display panel 110 is deformed to a deformation state 720 corresponding to a second exposed region ER2 smaller than the maximum exposed region ER1, the controller 150 may not receive the display data DDAT from the host processor 200, may generate scaled display data IMGD2 representing an image IMG2 having an aspect ratio substantially the same as the aspect ratio of the image IMG1 and a size suitable for the current exposed region ER2 in the deformation state 720 by performing a scale-down operation on the display data IMGD1 representing the image IMG1 corresponding to the maximum exposed region ER1, and may output corrected display data CDAT1 including the scaled display data IMGD2 as the output image data ODAT to the data driver 130. The data driver 130 may drive the rollable display panel 110 to display the image IMG2 having the size suitable for the current exposed region ER2 based on the corrected display data CDAT1.

Similarly, in third, fourth, and fifth frame periods FP3, FP4 and FP5 in which the rollable display panel 110 is deformed to deformation states 730, 740, and 750 such that the current exposed region ER3, ER4, and ER5 is gradually decreased, the controller 150 may not receive the display data DDAT from the host processor 200, may generate scaled display data IMGD3, IMGD4, and IMGD5 representing an image IMG3, IMG4, and IMG5 having an aspect ratio substantially the same as the aspect ratio of the image IMG1 and a size suitable for the current exposed region ER3, ER4, and ER5 in each deformation state 730, 740, and 750 by performing a scale-down operation on the display data IMGD1 representing the image IMG1 corresponding to the maximum exposed region ER1, and may output corrected display data CDAT2, CDAT3, and CDAT4 including the scaled display data IMGD3, IMGD4, and IMGD5 as the output image data ODAT to the data driver 130. The data driver 130 may drive the rollable display panel 110 to display the image IMGD3, IMGD4, and IMGD5 having the size suitable for the current exposed region ER3, ER4, and ER5 based on the corrected display data CDAT2, CDAT3, and CDAT4.

Although FIG. 7 illustrates an example where the rollable display panel 110 is deformed from the second deformation state 710 corresponding to the maximum exposed region ER1 to the first deformation state 750 corresponding to the minimum exposed region ER5 during four frame periods FP2, FP3, FP4, and FP5 each defined by a vertical synchronization signal VSYNC, the number of the frame periods FP2, FP3, FP4, and FP5 during which the rollable display panel 110 is deformed from the second deformation state 710 to the first deformation state 750 is not limited to the example of FIG. 7.

As described above, in the method of operating the flexible display device 100 according to embodiments, while the rollable display panel 110 is deformed, the panel driver 120 may drive the rollable display panel 110 to display the image IMG2, IMG3, IMG4, and IMG5 having the size suitable for the current exposed region ER2, ER3, ER4, and ER5 of the rollable display panel 110 by performing the scale-down operation on the display data IMGD1 stored before the deformation of the rollable display panel 110. Accordingly, while the rollable display panel 110 is deformed, the display data DDAT may not be transferred between the host processor 200 and the flexible display device 100, and power consumption may be reduced.

Figure 8:
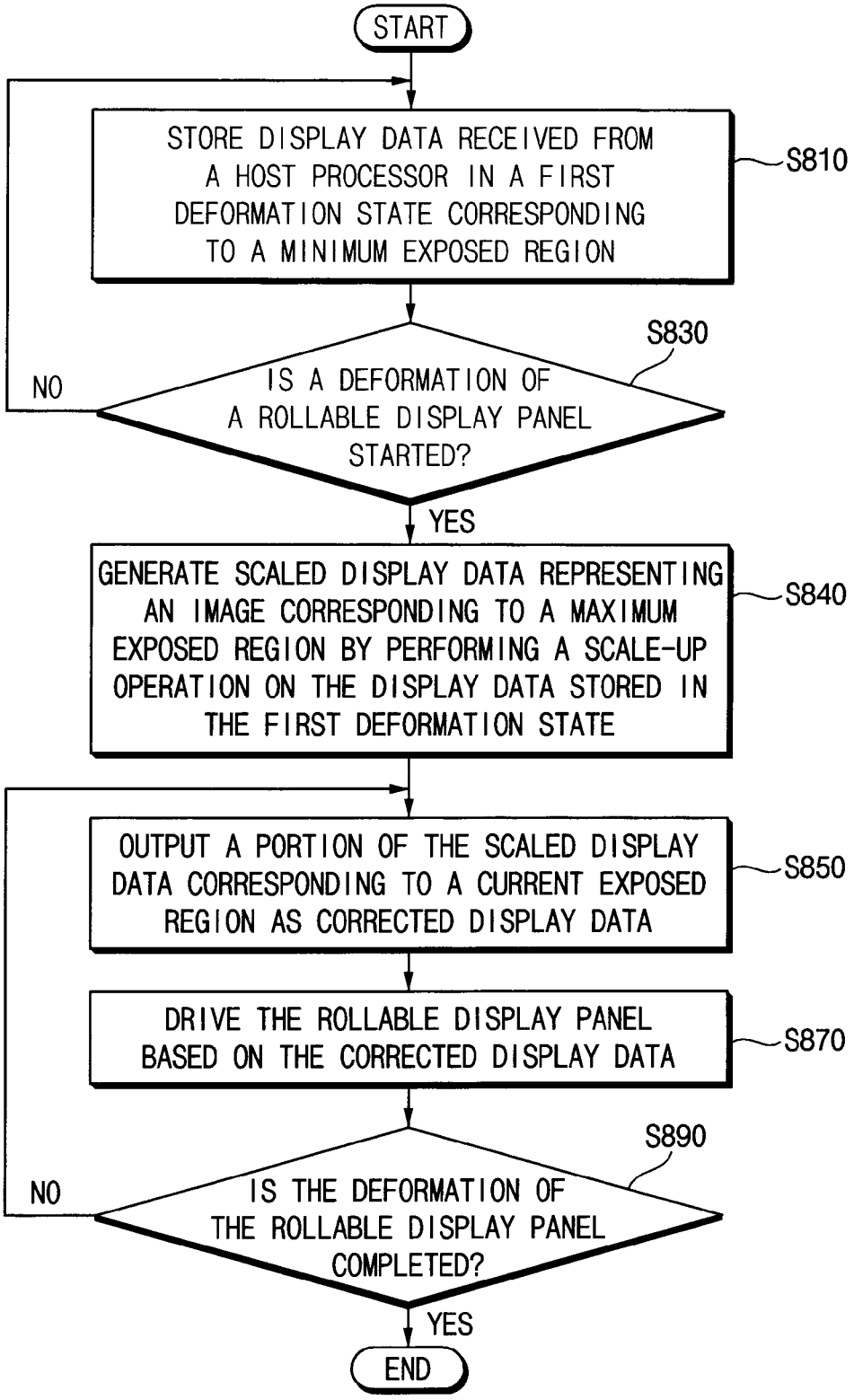
FIG. 8 is a flowchart illustrating a method of operating a flexible display device according to embodiments.

FIG. 8 is a flowchart illustrating a method of operating a flexible display device according to embodiments; and FIG. 9 is a diagram for describing an example of a method of operating a flexible display device according to embodiments.

Referring to FIGS. 1 and 8, in a method of operating a flexible display device 100 including a flexible display panel 110 according to embodiments, the flexible display panel 110 may be a rollable display panel. Before the rollable display panel 110 is deformed, as illustrated in FIG. 9, the rollable display panel 110 may be in a first deformation state 910 in which the rollable display panel 110 has a minimum exposed region ER1. In a first frame period FP1 before the rollable display panel 110 is deformed, a controller 150 of a panel driver 120 may receive display data IMGD1 for an image IMG1 corresponding to the minimum exposed region ER1 (and/or black image data for the remaining region of a display region DR except for the minimum exposed region ER1) as display data DDAT from a host processor 200, may store the display data IMGD1 for the image IMG1 corresponding to the minimum exposed region ER1 in a frame buffer 160 (S810), and may output display data DDAT' for the minimum exposed region ER1 among the display data DDAT received from the host processor 200 as output image data ODAT to a data driver 130. The data driver 130 of the panel driver 120 may drive the rollable display panel 110 to display the IMG1 corresponding to the minimum exposed region ER1 based on the display data DDAT'. In some embodiments, until the rollable display panel 110 is deformed (S830), these operations (S810) may be repeated.

When the rollable display panel 110 is started to be deformed from the first deformation state 910 to a second deformation state 950 in which the rollable display panel 110 has a maximum exposed region ER5 (S830: YES), the panel driver 120 may generate scaled display data SIMGD representing an image IMG5 corresponding to the maximum exposed region ER5, or the exposed region ER5 after the deformation of the rollable display panel 110 by performing a scale-up operation on the display data IMGD representing the image IMG1 corresponding to the minimum exposed region ER1 stored in the frame buffer 160 before the deformation of the rollable display panel 110 (S840). The panel driver 120 may store the scaled display data SIMGD representing the image IMG5 corresponding to the maximum exposed region ER5 in the frame buffer 160.

While the rollable display panel 110 is deformed from the first deformation state 910 to the second deformation state 950, the controller 150 of the panel driver 120 may output at least a portion SIMGD_P1, SIMGD_P2, SIMGD_P3, and SIMGD of the scaled display data SIMGD as corrected display data CDAT1, CDAT2, CDAT3, and CDAT4 such that an image IMG2, IMG3, IMG4, and IMG5 represented by the corrected display data CDAT1, CDAT2, CDAT3, and CDAT4 has a size suitable for a current exposed region ER2, ER3, ER4, and ER5, and the data driver 130 of the panel driver 120 may drive the rollable display panel 110 based on the corrected display data CDAT1, CDAT2, CDAT3, and CDAT4 (S850, S870, and S890).

For example, in a second frame period FP2 in which the rollable display panel 110 is deformed to a deformation state 920 corresponding to a second exposed region ER2 greater than the minimum exposed region ER1, the controller 150 may not receive the display data DDAT from the host processor 200, and may output, as the corrected display data CDAT1, a portion SIMGD_P1 of the scaled display data SIMGD representing an image IMG2 having a size suitable for a current exposed region ER2 in the deformation state 920 among the scaled display data SIMGD stored in the frame buffer 160. The data driver 130 may drive the rollable display panel 110 to display the image IMG2 having a size suitable for the current exposed region ER2 based on the corrected display data CDAT1, or the portion SIMGD_P1 of the scaled display data SIMGD.

Similarly, in third, fourth, and fifth frame periods FP3, FP4, and FP5 in which the rollable display panel 110 is deformed to deformation states 930, 940, and 950 such that the current exposed region ER3, ER4, and ER5 is gradually increased, the controller 150 may not receive the display data DDAT from the host processor 200, may output, as the corrected display data CDAT2, CDAT3, and CDAT4, at least a portion SIMGD_P2, SIMGD_P3, and SIMGD of the scaled display data SIMGD representing an image IMG3, IMG4, and IMG5 having a size suitable for the current exposed region ER3, ER4, and ER5 in each deformation state 930, 940, and 950 among the scaled display data SIMGD stored in the frame buffer 160. The data driver 130 may drive the rollable display panel 110 to display the image IMG3, IMG4, and IMG5 having the size suitable for the current exposed region ER3, ER4, and ER5 based on the corrected display data CDAT2, CDAT3, and CDAT4, or at least the portion SIMGD_P2, SIMGD_P3, and SIMGD of the scaled display data SIMGD.

As described above, in the method of operating the flexible display device 100 according to embodiments, while the rollable display panel 110 is deformed, the panel driver 120 may drive the rollable display panel 110 to display the image IMG2, IMG3, IMG4, and IMG5 having the size suitable for the current exposed region ER2, ER3, ER4, and ER5 of the rollable display panel 110 by performing the scale-up operation on the display data IMGD1 stored before the deformation of the rollable display panel 110. Accordingly, while the rollable display panel 110 is deformed, the display data DDAT may not be transferred between the host processor 200 and the flexible display device 100, and power consumption may be reduced.

Figure 10:
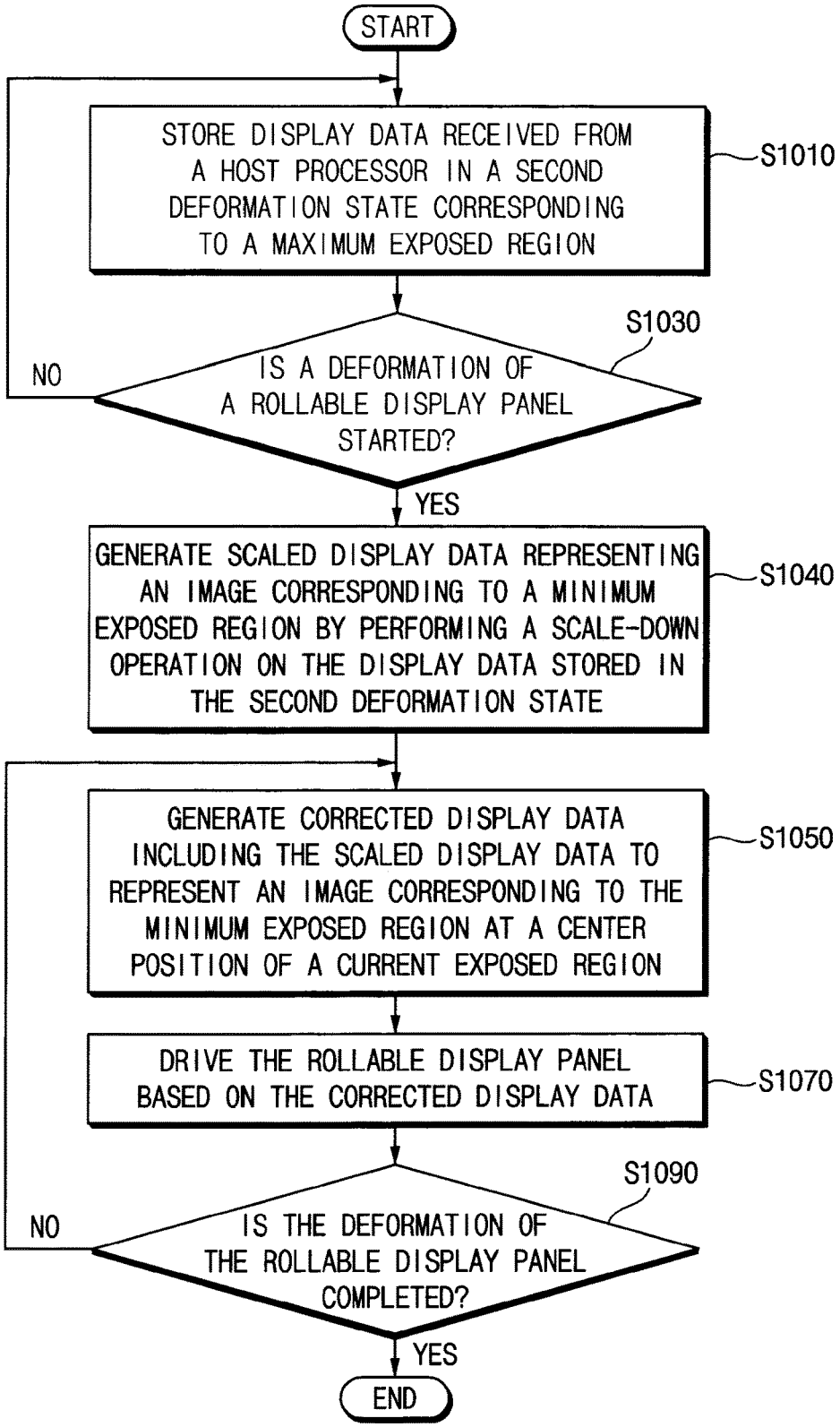
FIG. 10 is a flowchart illustrating a method of operating a flexible display device according to embodiments.

FIG. 10 is a flowchart illustrating a method of operating a flexible display device according to embodiments, and FIG. 11 is a diagram for describing an example of a method of operating a flexible display device according to embodiments.

Referring to FIGS. 1 and 10, in a method of operating a flexible display device 100 including a flexible display panel 110 according to embodiments, the flexible display panel 110 may be a rollable display panel. Before the rollable display panel 110 is deformed, as illustrated in FIG. 11, the rollable display panel 110 may be in a second deformation state 1110 in which the rollable display panel 110 has a maximum exposed region ER1. In a first frame period FP1 before the rollable display panel 110 is deformed, a controller 150 of a panel driver 120 may receive display data IMGD for an image IMG1 corresponding to the maximum exposed region ER1 as display data DDAT from a host processor 200; may store the display data IMGD for the image IMG1 corresponding to the maximum exposed region ER1 in a frame buffer 160 (S1010); and may output the display data DDAT received from the host processor 200 or the display data IMGD for the maximum exposed region ER1 as output image data ODAT to a data driver 130. The data driver 130 of the panel driver 120 may drive the rollable display panel 110 to display the IMG1 corresponding to the maximum exposed region ER1 based on the display data IMGD. In some embodiments, until the rollable display panel 110 is deformed (S1030), these operations (S1010) may be repeated.

When the rollable display panel 110 is started to be deformed from the second deformation state 1110 to a first deformation state 1150 in which the rollable display panel 110 has a minimum exposed region ER5 (S1030: YES), the panel driver 120 may generate scaled display data SIMGD representing an image IMG5 corresponding to the minimum exposed region ER5, or the exposed region ER5 after the deformation of the rollable display panel 110 by performing a scale-down operation on the display data IMGD representing the image IMG1 corresponding to the maximum exposed region ER1 stored in the frame buffer 160 before the deformation of the rollable display panel 110 (S1040). The panel driver 120 may store the scaled display data SIMGD representing the image IMG5 corresponding to the minimum exposed region ER5 in the frame buffer 160.

While the rollable display panel 110 is deformed from the second deformation state 1110 to the first deformation state 1150, the controller 150 of the panel driver 120 may output corrected display data CDAT1, CDAT2, CDAT3, and CDAT4 including the scaled display data SIMGD to represent an image IMG2, IMG3, IMG4, and IMG5 corresponding to the minimum exposed region ER5 at a center position of a current exposed region ER2, ER3, ER4, and ER5, and the data driver 130 of the panel driver 120 may drive the rollable display panel 110 based on the corrected display data CDAT1, CDAT2, CDAT3, and CDAT4 (S1050, S1070, and S1090).

For example, in a second frame period FP2 in which the rollable display panel 110 is deformed to a deformation state 1120 corresponding to a second exposed region ER2 smaller than the maximum exposed region ER1, the controller 150 may not receive the display data DDAT from the host processor 200, and may output the corrected display data CDAT1 including the scaled display data SIMGD to represent the image IMG2 at the center position of the current exposed region ER2. The data driver 130 may drive the rollable display panel 110 to display the image IMG2 at the center position of the current exposed region ER2 based on the corrected display data CDAT1.

Similarly, in third, fourth, and fifth frame periods FP3, FP4, and FP5 in which the rollable display panel 110 is deformed to deformation states 1130, 1140, and 1150 such that the current exposed region ER3, ER4, and ER5 is gradually decreased, the controller 150 may not receive the display data DDAT from the host processor 200, may output the corrected display data CDAT2, CDAT3, and CDAT4 including the scaled display data SIMGD to represent the image IMG3, IMG4, and IMG5 at the center position of the current exposed region ER3, ER4, and ER5 in each deformation state 1130, 1140, and 1150. The data driver 130 may drive the rollable display panel 110 to display the image IMG3, IMG4, and IMG5 at the center position of the current exposed region ER3, ER4, and ER5 based on the corrected display data CDAT2, CDAT3, and CDAT4.

As described above, in the method of operating the flexible display device 100 according to embodiments, while the rollable display panel 110 is deformed, the panel driver 120 may drive the rollable display panel 110 to display the image IMG2, IMG3, IMG4, and IMG5 having the size suitable for the current exposed region ER2, ER3, ER4, and ER5 of the rollable display panel 110 by performing the scale-down operation on the display data IMGD stored before the deformation of the rollable display panel 110. Accordingly, while the rollable display panel 110 is deformed, the display data DDAT may not be transferred between the host processor 200 and the flexible display device 100, and power consumption may be reduced.

Figure 12:
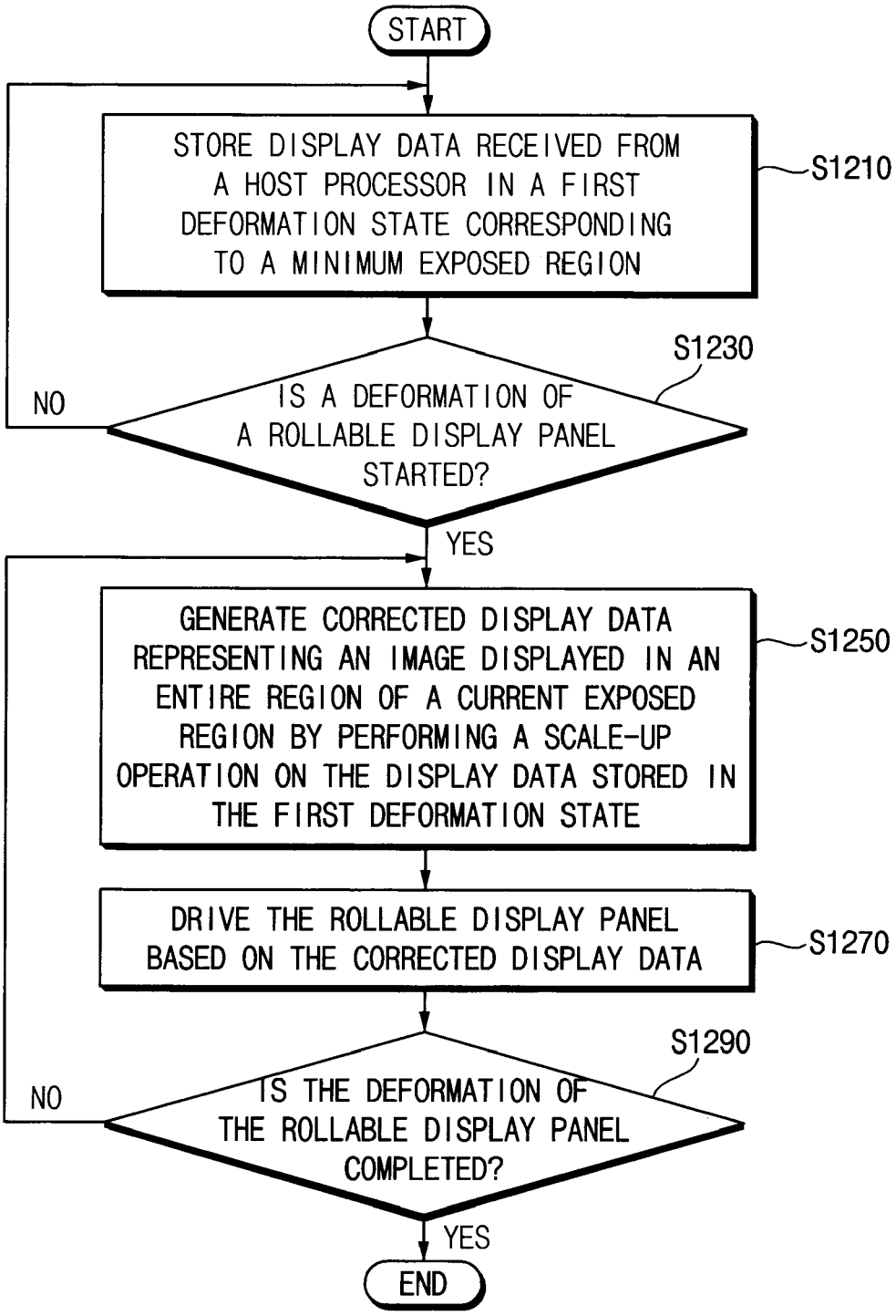
FIG. 12 is a flowchart illustrating a method of operating a flexible display device according to embodiments.
Figure 13:
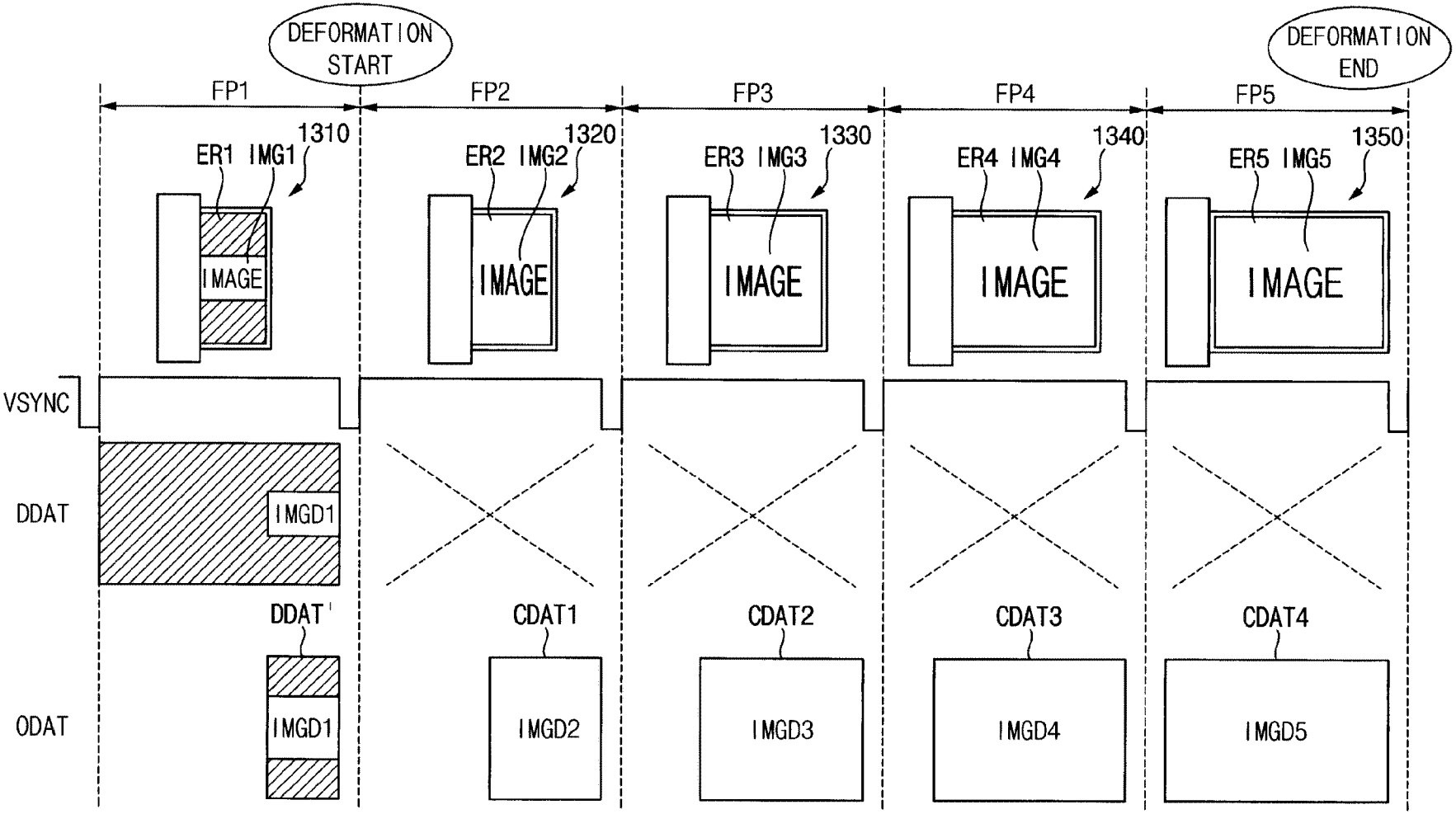
FIG. 13 is a diagram for describing an example of a method of operating a flexible display device according to embodiments.

FIG. 12 is a flowchart illustrating a method of operating a flexible display device according to embodiments, and FIG. 13 is a diagram for describing an example of a method of operating a flexible display device according to embodiments.

Referring to FIGS. 1 and 12, in a method of operating a flexible display device 100 including a flexible display panel 110 according to embodiments, the flexible display panel 110 may be a rollable display panel. Before the rollable display panel 110 is deformed, a panel driver 120 may receive display data DDAT from a host processor 200; may store the display data DDAT received from the host processor 200 in a frame buffer 160 (S1210); and may drive the rollable display panel 110 based on the display data DDAT. In some embodiments, before the rollable display panel 110 is deformed, as illustrated in FIG. 13, the rollable display panel 110 may be in a first deformation state 1310 corresponding to a minimum exposed region ER1. Further, until the rollable display panel 110 is deformed (S1230), these operations (S1210) may be repeated.

While the rollable display panel 110 is deformed (S1230: YES), the panel driver 120 may generate corrected display data CDAT1, CDAT2, CDAT3, and CDAT4 representing an image IMG2, IMG3, IMG4, and IMG5 displayed in an entire region of a current exposed region ER2, ER3, ER4, and ER5 (or an image IMG2, IMG3, IMG4, and IMG5 that fills the entire exposed region ER2, ER3, ER4, and ER5) in each deformation state 1320, 1330, 1340, and 1350 by performing, in each deformation state 1320, 1330, 1340, and 1350, a scale-up operation on the display data IMGD1 representing the image IMG1 corresponding to the minimum exposed region ER1 stored in the first deformation state 1310 (S1250), and may drive the rollable display panel 110 based on the corrected display data CDAT1, CDAT2, CDAT3, and CDAT4 (S1270). In some embodiments, until the deformation of the rollable display panel 110 is completed (S1290), these operations (S1250 and S1270) may be repeated.

Figure 14:
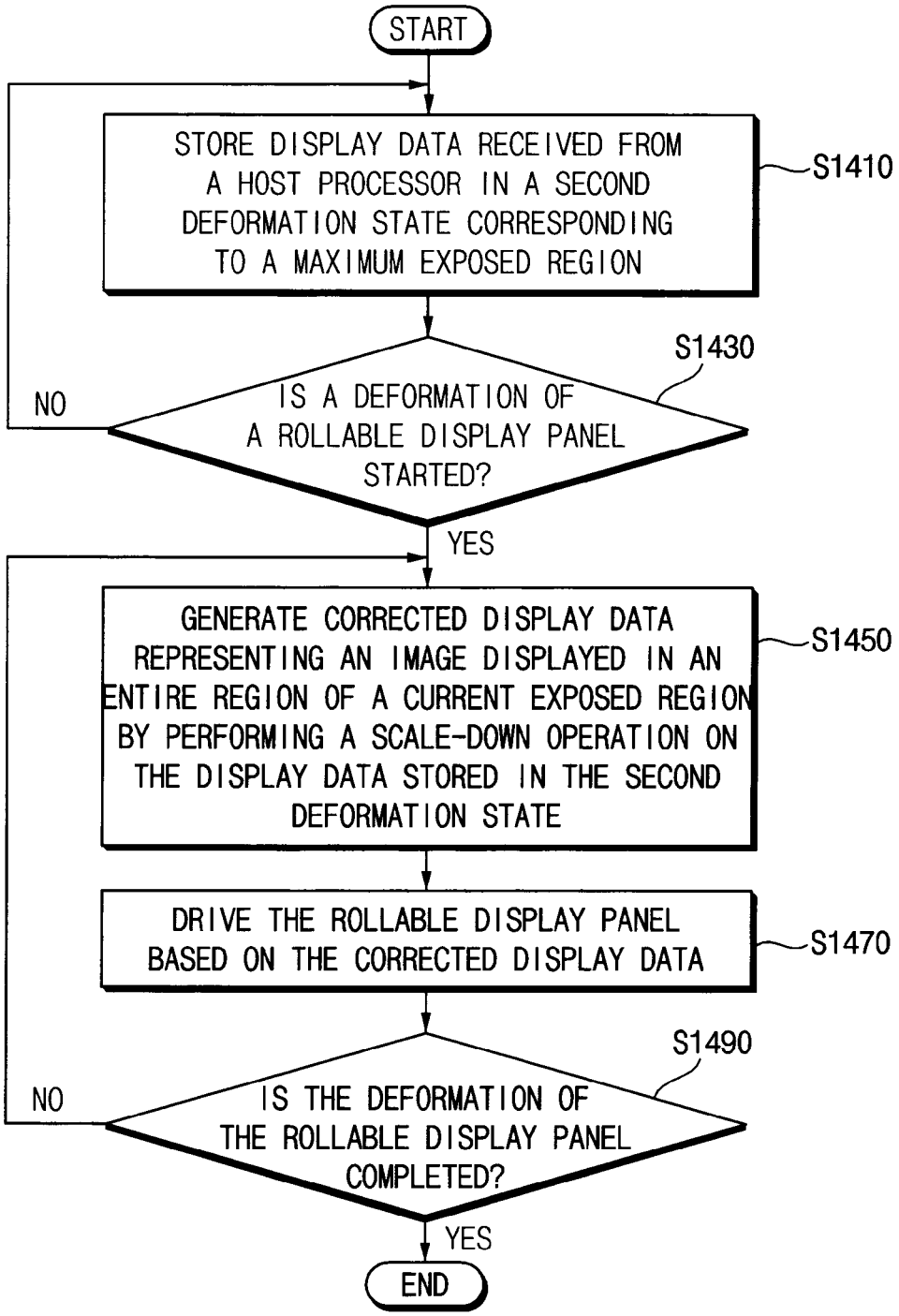
FIG. 14 is a flowchart illustrating a method of operating a flexible display device according to embodiments.
Figure 15:
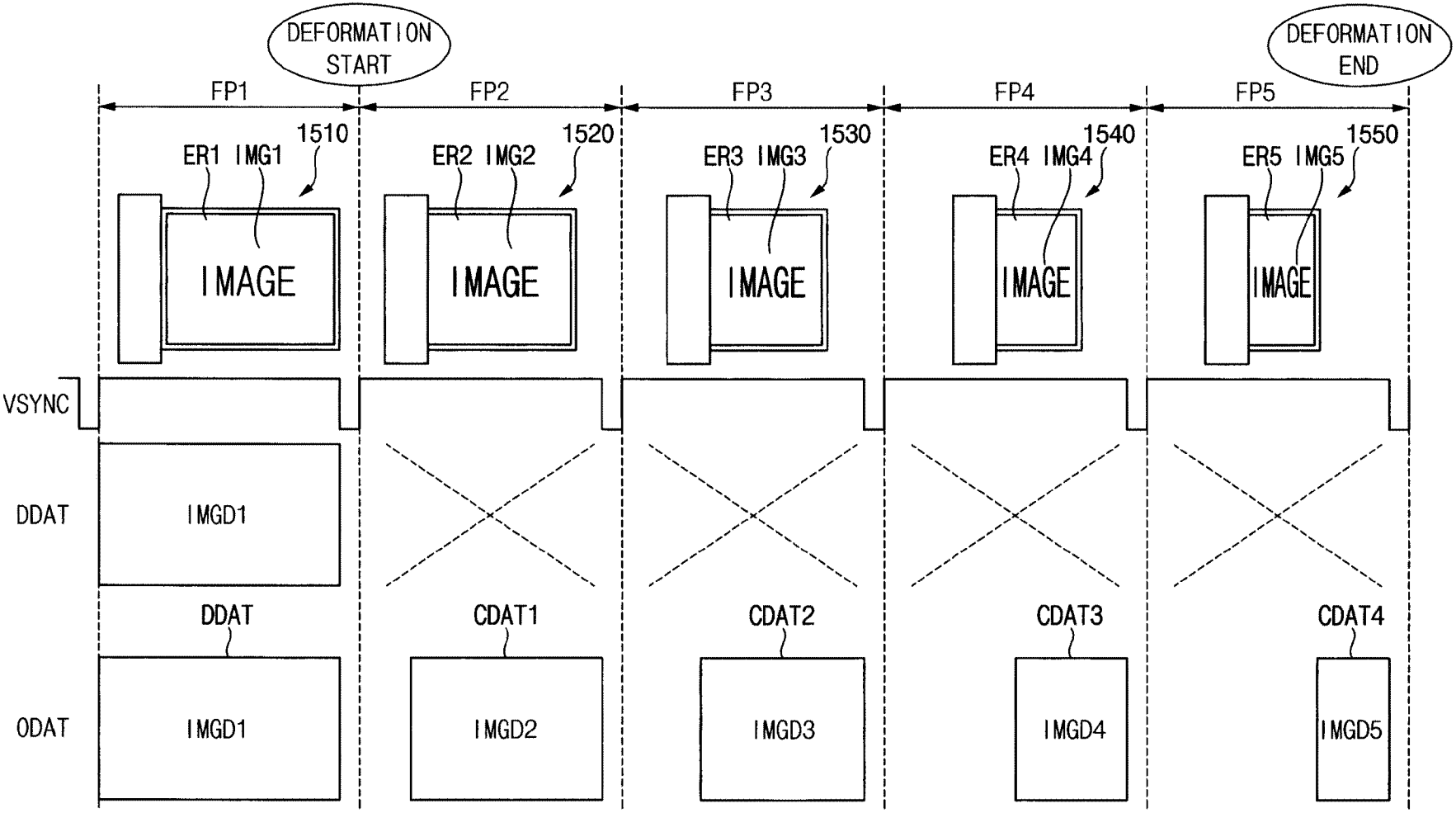
FIG. 15 is a diagram for describing an example of a method of operating a flexible display device according to embodiments.

FIG. 14 is a flowchart illustrating a method of operating a flexible display device according to embodiments, and FIG. 15 is a diagram for describing an example of a method of operating a flexible display device according to embodiments.

Referring to FIGS. 1 and 14, in a method of operating a flexible display device 100 including a flexible display panel 110 according to embodiments, the flexible display panel 110 may be a rollable display panel. Before the rollable display panel 110 is deformed, as illustrated in FIG. 15, the rollable display panel 110 may be in a second deformation state 1510 in which the rollable display panel 110 has a maximum exposed region ER1. In a first frame period FP1 before the rollable display panel 110 is deformed, a controller 150 of a panel driver 120 may receive display data IMGD1 for an image IMG1 corresponding to the maximum exposed region ER1 as display data DDAT from a host processor 200, may store the display data IMGD for the image IMG1 corresponding to the maximum exposed region ER1 in a frame buffer 160 (S1410), and may output the display data DDAT received from the host processor 200 or the display data IMGD1 for the maximum exposed region ER1 as output image data ODAT to a data driver 130. The data driver 130 of the panel driver 120 may drive the rollable display panel 110 to display the IMG1 corresponding to the maximum exposed region ER1 based on the display data DDAT or the display data IMGD1. In some embodiments, until the rollable display panel 110 is deformed (S1430), these operations (S1410) may be repeated.

While the rollable display panel 110 is deformed (S1430: YES), the panel driver 120 may generate corrected display data CDAT1, CDAT2, CDAT3, and CDAT4 representing an image IMG2, IMG3, IMG4, and IMG5 displayed in an entire region of a current exposed region ER2, ER3, ER4, and ER5 (or an image IMG2, IMG3, IMG4, and IMG5 that fills the entire exposed region ER2, ER3, ER4, and ER5) in each deformation state 1520, 1530, 1540 and 1550 by performing, in each deformation state 1520, 1530, 1540, and 1550, a scale-down operation on the display data IMGD1 representing the image IMG1 corresponding to the maximum exposed region ER1 stored in the second deformation state 1510 (S1450), and may drive the rollable display panel 110 based on the corrected display data CDAT1, CDAT2, CDAT3, and CDAT4 (S1470). In some embodiments, until the deformation of the rollable display panel 110 is completed (S1490), these operations (S1450 and S1470) may be repeated.

The inventive concepts may be applied to any electronic device including the flexible display device 100, such as a mobile phone, a smart phone, a tablet computer, a television (TV), a digital TV, a 3D TV, a wearable electronic device, a personal computer (PC), a home appliance, a laptop computer, a personal digital assistant (PDA), a portable multimedia player (PMP), a digital camera, a music player, a portable game console, a navigation device, etc.

As described above, in a flexible display device and a method of operating the flexible display device according to the inventive concepts, while a flexible display panel is deformed, a panel driver may drive the flexible display panel based on display data stored before the flexible display panel is deformed to display an image having a size suitable for a current exposed region of the flexible display panel. Accordingly, while the flexible display panel is deformed, the display data may not be transferred between a host processor and the flexible display device, and power consumption may be reduced.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A flexible display device comprising:

a flexible display panel; and a panel driver configured to:

receive display data from a host processor;

store the display data; and drive the flexible display panel based on the display data, wherein:

while the flexible display panel is deformed, the panel driver drives the flexible display panel based on the display data stored before the flexible display panel is deformed to display an image having a size suitable for a current exposed region of the flexible display panel; and while the flexible display panel is deformed, the panel driver does not receive the display data from the host processor.

2. The flexible display device of claim 1, wherein, while the flexible display panel is deformed, components of the panel driver for receiving the display data are disabled.

3. The flexible display device of claim 1, wherein, while the flexible display panel is deformed, the panel driver receives deformation information representing the current exposed region, generates corrected display data representing the image having the size suitable for the current exposed region by correcting the display data stored before the flexible display panel is deformed based on the deformation information, and drives the flexible display panel based on the corrected display data.

4. The flexible display device of claim 3, wherein:

while the flexible display panel is deformed, the current exposed region of the flexible display panel is gradually changed; and while the flexible display panel is deformed, the panel driver performs a scaling operation on the display data stored before the flexible display panel is deformed such that an image represented by the corrected display data has an aspect ratio substantially equal to an aspect ratio of an image represented by the display data stored before the flexible display panel is deformed and has the size suitable for the current exposed region.

5. The flexible display device of claim 3, wherein:

while the flexible display panel is deformed, the current exposed region of the flexible display panel is gradually changed;

when a deformation of the flexible display panel is started, the panel driver generates scaled display data representing an image corresponding to an exposed region of the flexible display panel after the deformation of the flexible display panel is completed by performing a scaling operation on the display data stored before the flexible display panel is deformed; and while the flexible display panel is deformed, the panel driver outputs at least a portion of the scaled display data as the corrected display data such that an image represented by the corrected display data has the size or a position suitable for the current exposed region.

6. The flexible display device of claim 1, wherein the flexible display panel is a rollable display panel.

7. The flexible display device of claim 6, wherein:

in a first deformation state in which the rollable display panel has a minimum exposed region, the panel driver stores the display data representing an image corresponding to the minimum exposed region; and while the rollable display panel is deformed from the first deformation state to a second deformation state in which the rollable display panel has a maximum exposed region, the panel driver generates corrected display data representing an image having an aspect ratio substantially equal to an aspect ratio of the image corresponding to the minimum exposed region and having the size suitable for the current exposed region by performing a scale-up operation on the display data representing the image corresponding to the minimum exposed region, and drives the rollable display panel based on the corrected display data.

8. The flexible display device of claim 6, wherein:

in a second deformation state in which the rollable display panel has a maximum exposed region, the panel driver stores the display data representing an image corresponding to the maximum exposed region; and while the rollable display panel is deformed from the second deformation state to a first deformation state in which the rollable display panel has a minimum exposed region, the panel driver generates corrected display data representing an image having an aspect ratio substantially equal to an aspect ratio of the image corresponding to the maximum exposed region and having the size suitable for the current exposed region by performing a scale-down operation on the display data representing the image corresponding to the maximum exposed region, and drives the rollable display panel based on the corrected display data.

9. The flexible display device of claim 6, wherein:

in a first deformation state in which the rollable display panel has a minimum exposed region, the panel driver stores the display data representing an image corresponding to the minimum exposed region;

when the rollable display panel is started to be deformed from the first deformation state to a second deformation state in which the rollable display panel has a maximum exposed region, the panel driver generates scaled display data representing an image corresponding to the maximum exposed region by performing a scale-up operation on the display data representing the image corresponding to the minimum exposed region; and while the rollable display panel is deformed from the first deformation state to the second deformation state, the panel driver outputs a portion of the scaled display data corresponding to the current exposed region as corrected display data, and drives the rollable display panel based on the corrected display data.

10. The flexible display device of claim 6, wherein:

in a second deformation state in which the rollable display panel has a maximum exposed region, the panel driver stores the display data representing an image corresponding to the maximum exposed region;

when the rollable display panel is started to be deformed from the second deformation state to a first deformation state in which the rollable display panel has a minimum exposed region, the panel driver generates scaled display data representing an image corresponding to the minimum exposed region by performing a scale-down operation on the display data representing the image corresponding to the maximum exposed region; and while the rollable display panel is deformed from the second deformation state to the first deformation state, the panel driver outputs corrected display data including the scaled display data to represent the image corresponding to the minimum exposed region at a center position of the current exposed region, and drives the rollable display panel based on the corrected display data.

11. The flexible display device of claim 6, wherein:

in a first deformation state in which the rollable display panel has a minimum exposed region, the panel driver stores the display data representing an image corresponding to the minimum exposed region; and while the rollable display panel is deformed from the first deformation state to a second deformation state in which the rollable display panel has a maximum exposed region, the panel driver generates corrected display data representing an image displayed in an entire region of the current exposed region by performing a scale-up operation on the display data representing the image corresponding to the minimum exposed region, and drives the rollable display panel based on the corrected display data.

12. The flexible display device of claim 6, wherein:

in a second deformation state in which the rollable display panel has a maximum exposed region, the panel driver stores the display data representing an image corresponding to the maximum exposed region; and while the rollable display panel is deformed from the second deformation state to a first deformation state in which the rollable display panel has a minimum exposed region, the panel driver generates corrected display data representing an image displayed in an entire region of the current exposed region by performing a scale-down operation on the display data representing the image corresponding to the maximum exposed region, and drives the rollable display panel based on the corrected display data.

13. The flexible display device of claim 1, further comprising a sensor formed on the flexible display panel and configured to sense a deformation of the flexible display panel, wherein, while the flexible display panel is deformed, the panel driver receives deformation information representing the current exposed region from the sensor.

14. The flexible display device of claim 1, wherein the panel driver includes:

a frame buffer;

a controller configured to:

receive the display data and an instruction from the host processor;

store the display data in the frame buffer; and read the display data from the frame buffer;

a data driver configured to provide data signals to the flexible display panel based on the display data received from the controller; and a scan driver configured to provide scan signals to the flexible display panel.

15. The flexible display device of claim 14, wherein the controller includes:

an input interface configured to receive the display data and the instruction from the host processor;

a memory controller configured to store the display data in the frame buffer, and to read the display data from the frame buffer;

an instruction controller configured to control the controller based on the instruction received from the host processor; and a scaler configured to perform a scaling operation on the display data read from the frame buffer when the flexible display panel is deformed.

16. A flexible display device comprising:

a flexible display panel; and a panel driver configured to:

receive display data from a host processor;

store the display data; and drive the flexible display panel based on the display data, wherein:

while the flexible display panel is deformed, the panel driver drives the flexible display panel based on the display data stored before the flexible display panel is deformed to display an image having a size suitable for a current exposed region of the flexible display panel;

the panel driver includes:

a frame buffer;

a controller configured to:

receive the display data and an instruction from the host processor;

store the display data in the frame buffer; and read the display data from the frame buffer;

a data driver configured to provide data signals to the flexible display panel based on the display data received from the controller; and a scan driver configured to provide scan signals to the flexible display panel;

the controller includes:

an input interface configured to receive the display data and the instruction from the host processor;

a memory controller configured to store the display data in the frame buffer, and to read the display data from the frame buffer;

an instruction controller configured to control the controller based on the instruction received from the host processor; and a scaler configured to perform a scaling operation on the display data read from the frame buffer when the flexible display panel is deformed; and while the flexible display panel is deformed, at least a portion of the input interface is disabled.

17. A flexible display device comprising:

a flexible display panel; and a panel driver configured to:

receive display data from a host processor;

store the display data; and drive the flexible display panel based on the display data, wherein:

while the flexible display panel is deformed, the panel driver drives the flexible display panel based on the display data stored before the flexible display panel is deformed to display an image having a size suitable for a current exposed region of the flexible display panel;

the panel driver includes:

a frame buffer;

a controller configured to:

receive the display data and an instruction from the host processor;

store the display data in the frame buffer; and read the display data from the frame buffer;

a data driver configured to provide data signals to the flexible display panel based on the display data received from the controller; and a scan driver configured to provide scan signals to the flexible display panel; and the input interface includes:

a physical circuit configured to convert the display data and the instruction that are analog signals into digital signals;

a deserialization circuit configured to convert the display data and the instruction that are serial signals into parallel signals;

a buffer circuit configured to temporarily store the display data and the instruction; and a latch circuit configured to output the display data and the instruction; and the memory controller includes:

an encoder configured to encode the display data such that the encoded display data are stored in the frame buffer; and a decoder configured to decode the encoded display data read from the frame buffer.

18. The flexible display device of claim 17, wherein, while the flexible display panel is deformed, at least a portion of the physical circuit, at least a portion of the deserialization circuit, at least a portion of the buffer circuit, at least a portion of the latch circuit, and the encoder are disabled.

* * * * *